US010694280B1

(12) United States Patent
Combest et al.

(10) Patent No.: US 10,694,280 B1
(45) Date of Patent: Jun. 23, 2020

(54) HANGING SPEAKER SYSTEM

(71) Applicant: MS ELECTRONICS LLC, Lenexa, KS (US)

(72) Inventors: Christopher E. Combest, Leawood, KS (US); Lindsey K. Humphrey, Kansas City, MO (US); Kenneth Hecht, Jacksonville, FL (US)

(73) Assignee: MS ELECTRONICS LLC, Overland Park, KS (US)

( * ) Notice: Subject to any disclaimer, the term of this patent is extended or adjusted under 35 U.S.C. 154(b) by 0 days.

(21) Appl. No.: 16/744,368

(22) Filed: Jan. 16, 2020

Related U.S. Application Data

(63) Continuation-in-part of application No. 16/653,588, filed on Oct. 15, 2019, which is a continuation-in-part of application No. 16/394,708, filed on Apr. 25, 2019, now Pat. No. 10,448,148, which is a continuation-in-part of application No. 16/244,268, filed on Jan. 10, 2019.

(51) Int. Cl.
*H04R 1/00* (2006.01)
*H04R 1/28* (2006.01)

(52) U.S. Cl.
CPC ..... *H04R 1/28* (2013.01); *H04R 1/2803* (2013.01); *H04R 1/2807* (2013.01)

(58) Field of Classification Search
CPC ..... H04R 1/28; H04R 1/2803; H04R 1/2807; H04R 1/2811; H04R 1/2815; H04R 1/1819; H04R 1/2823; H04R 1/2826
See application file for complete search history.

(56) References Cited

U.S. PATENT DOCUMENTS 3,529,691 A * 9/1970 Wesemann ..... H04R 1/2811 181/156
4,348,549 A * 9/1982 Berlant ..... H04R 1/26 181/152
5,189,706 A * 2/1993 Saeki ..... H04R 1/2826 181/155
5,721,401 A * 2/1998 Sim ..... H04R 1/345 181/148
5,995,634 A * 11/1999 Zwolski ..... H04R 1/028 181/155

(Continued)

*Primary Examiner* — Matthew A Eason
(74) *Attorney, Agent, or Firm* — Hovey Williams LLP

(57) ABSTRACT

A speaker system broadly comprises a plurality of speaker assemblies each including a speaker housing, an input circuit, a low range speaker, and a higher-range speaker. The input circuit receives audio signals from a sound system or other controller and actively or passively sends the audio signals to the speakers. The low-range speaker is positioned in the upper section and the higher-range speaker is positioned in the lower section. Each speaker assembly is configured to be spaced from the other speaker assemblies within a listening area with each speaker assembly generating low frequency soundwaves and higher-frequency soundwaves. This reduces or eliminates out-of-phase crossover frequency wave cancellation effects within the listening area. The speaker housings are compact while allowing the low-range speaker and higher-range speaker to effectively produce and project desired soundwaves from the suspended speaker housing into the listening area.

20 Claims, 15 Drawing Sheets

(56) References Cited

U.S. PATENT DOCUMENTS

| | | | | | |
|---|---|---|---|---|---|
| 6,144,751 | A * | 11/2000 | Velandia | H04R 1/2826 | 181/153 |
| 6,597,797 | B1 * | 7/2003 | Betts | H04R 1/345 | 181/155 |
| 6,604,602 | B1 * | 8/2003 | Kim | H04R 1/2842 | 181/189 |
| 7,606,379 | B2 * | 10/2009 | Ivey | F21V 7/0008 | 381/160 |
| 8,098,852 | B2 * | 1/2012 | Harwood | H04R 5/02 | 181/153 |
| 8,275,164 | B1 * | 9/2012 | Nguyen | H04R 1/2857 | 381/337 |
| 8,442,242 | B2 * | 5/2013 | Harwood | G10K 11/28 | 181/176 |
| 2016/0227315 | A1 * | 8/2016 | Kim | H04R 1/2811 | |
| 2016/0337748 | A1 * | 11/2016 | Goksel | H04R 1/2896 | |
| 2017/0006376 | A1 * | 1/2017 | Tan | H04R 1/20 | |
| 2017/0094403 | A1 * | 3/2017 | Tipparaju | H04R 1/288 | |

* cited by examiner 300
302
312
324
314
304
316
326

CHAMBER 320
LOW FREQUENCY DRIVER 322
SEALED CHAMBER FOR FULL RANGE DRIVER 332
FULL RANGE DRIVER 310
LEGS FOR SPEAKER ATTACHMENT 306
VENTED CHAMBER 330
SLOT WITH OPENING ALONG SPEAKER DIAMETER 324
PORTS 334
ACOUSTIC DISPERSION PLATE 344
SECTION A-A

TITLE:
SIZE
DWG. NO.
REV

HANGING SPEAKER SYSTEM

RELATED APPLICATIONS

This patent application is a continuation-in-part, and claims priority benefit with regard to all common subject matter, of earlier-filed non-provisional U.S. patent application Ser. No. 16/653,588, filed on Oct. 15, 2019, and entitled "HANGING SPEAKER SYSTEM". U.S. patent application Ser. No. 16/653,588 is a continuation-in-part, and claims priority benefit with regard to all common subject matter, of earlier-filed non-provisional U.S. patent application Ser. No. 16/394,708, filed on Apr. 25, 2019, entitled "HANGING SPEAKER SYSTEM", and issued as U.S. Pat. No. 10,448,148 on Oct. 15, 2019. U.S. patent application Ser. No. 16/394,708 is a continuation-in-part, and claims priority benefit with regard to all common subject matter, of earlier-filed non-provisional U.S. patent application Ser. No. 16/244,268, filed on Jan. 10, 2019, and entitled "HANGING SPEAKER SYSTEM". The identified earlier-filed non-provisional patent applications and issued patent are hereby incorporated by reference in their entireties into the present application.

BACKGROUND

Speakers are often used in shopping areas, atriums, foyers, pavilions, and other at least partially enclosed areas for reproducing music, talk radio, and other audio. Conventional speaker systems often include a low-range speaker such as a subwoofer and a number of higher-range speakers spaced from the low-range speaker. The frequency ranges of the low-range speaker and the higher-range speakers often overlap, with crossover frequency soundwaves being generated by both the low range speaker and the higher-range speakers. When the speakers are spaced apart, the crossover frequency soundwaves are often out of phase with each other in portions of the listening area, thus resulting in unwanted wave cancellation or muting effects.

SUMMARY

Embodiments of the invention solve the above-mentioned problems and provide a distinct advance in the art of speaker assemblies and speaker systems. More particularly, the invention provides a hanging speaker system broadly comprising a number of speaker assemblies configured to be hung from a ceiling or other elevated structure to form a listening area. Each speaker assembly generates low frequency soundwaves and higher frequency soundwaves while reducing or eliminating out-of-phase crossover frequency wave cancellation effects when spaced from the other speaker assemblies within the listening area.

Each speaker assembly of the speaker system broadly comprises a speaker housing, a hanging component, an input circuit, a low range speaker, and a higher-range speaker. The speaker housing broadly comprises an upper section and a lower section. The speaker housing may be substantially cylindrical or any other suitable shape and narrow for allowing the speaker assembly to be less conspicuous and positioned in narrow spaces.

The upper section encloses the low range speaker and broadly comprises an outer wall and a divider. The outer wall defines an upper chamber and a lower chamber. A lower end of the outer wall may be flared radially outward slightly, the purpose of which will be described below. The upper section may be formed of PVC or other plastic, metal, or any other suitable material and may be waterproof and/or corrosion resistant.

The upper section also includes a connector for securing the speaker housing to the hanging component. The connector is positioned near a middle of the top of the upper section so that the speaker assembly is balanced and oriented vertically upright when hanging from the ceiling. Alternatively, the connector may have three or more mounting points along a top periphery of the speaker housing.

The upper chamber retains the low-range speaker therein and is acoustically shaped for projecting low frequency soundwaves generated by the low-range speaker down to the lower chamber. The upper chamber may also have any suitable size for optimizing the projection of low frequency soundwaves therefrom.

The lower chamber encircles at least a portion of the lower section and allows low frequency soundwaves generated by the low range speaker to pass out of a lower port exit of the speaker housing via a lower port channel. The lower chamber is acoustically shaped and may have any suitable size for optimizing the projection of low frequency soundwaves generated by the low range speaker downwards through the lower port channel and outwards through the lower port exit.

The divider extends horizontally in the upper section and partitions the upper section into the upper chamber and the lower chamber. The divider also supports the low-range speaker such that the low-range speaker is spaced from a top of the upper section.

The lower section encloses the higher-range speaker and broadly comprises an outer wall, a baffle, and a plurality of vanes. The outer wall includes an upper portion and a lower portion and forms an inner chamber. The lower section and the outer wall cooperatively form the lower port exit.

The upper portion extends upwards into the lower chamber of the upper section and thus has a smaller outer diameter than an inner diameter of the outer wall. The upper portion also has a smaller outer diameter than an outer diameter of the lower portion. The upper portion extends upwards a selected vertical length into the lower chamber so as to effect a desired length of the lower port channel. This optimizes low frequency output. If a cross section area of the lower port channel and/or the lower port exit is increased, the length of the lower port channel should be increased for a given tuning. Likewise, if the cross section area of the lower port channel and/or the lower port exit is decreased, the length of the lower port channel should be decreased. Meanwhile, decreasing the cross section area of the lower port exit increases air velocity therethrough, which may cause port noise. Thus, the lower end of the outer wall of the upper section near the lower port exit may be flared radially outward slightly so as to increase the cross section area of the lower port exit and thereby reduce port noise. A longer flare may provide more port noise mitigation.

The lower portion has a larger diameter than the upper portion and has an outer diameter substantially equal to the outer diameter of the outer wall. As such, the lower portion and the outer wall of the upper section appear essentially as vertical extensions of each other separated by the lower port exit.

The inner chamber encloses the higher range speaker therein and is acoustically shaped for projecting higher-frequency soundwaves. The inner chamber may have any suitable size for optimizing the projection of higher-frequency soundwaves.

The baffle encloses the inner chamber of the lower section and extends radially beyond the lower portion. The baffle concentrates higher frequency soundwaves below the speaker assembly. The baffle may be sized to optimize directivity and amplitude of the higher frequency soundwaves. The baffle may be a cover, a plate, or any other suitable enclosing structure.

The vanes extend radially outward from the upper portion of the outer wall of the lower section to the outer wall of the upper section so as to connect the lower section to the upper section. The vanes also divide the lower port channel into a plurality of radial spaces. The radial spaces are vertically extending pathways through which low frequency soundwaves from the low-range speaker may pass from the lower chamber to the lower port exit.

The hanging component suspends the speaker assembly from a ceiling or other elevated structure and is secured to an anchor or other mounting feature of the ceiling near its upper end and is secured to the connector at its lower end. The hanging component may support or house electrical or electronic wiring connected between the input circuit and a sound system and/or a power source. The hanging component may be a cable, a chain, a wire, a rope, a rigid member, or any other suitable structure.

The input circuit receives audio signals from the sound system and actively or passively sends the audio signals to the speakers. The input circuit may include an antenna, data bus, data port, or any other suitable communication component, an amplifier, a mixer, or any other suitable sound manipulation component. The input circuit may be connected directly to the low range speaker and/or higher-range speaker or through a passive crossover. The input circuit may be positioned in the upper section, the lower section, or any other location for improving signal reception.

The low range speaker generates low frequency soundwaves and is positioned in or mounted to the divider and aimed upwards or downwards for projecting the low frequency soundwaves through the lower port channel (via the radial spaces) and out the lower port exit. The low range speaker may be a woofer, subwoofer, bass speaker, or other low-range speaker.

The higher-range speaker generates higher frequency soundwaves and is positioned in or mounted to the baffle. The higher-range speaker is aimed downwards for projecting higher frequencies. The higher-range speaker may be a full range speaker, a woofer with a tweeter, a woofer with a midrange and tweeter, or any other similar speaker or combination of speakers.

The speaker assembly provides several advantages. For example, the speaker assembly is spaced apart from other speaker assemblies throughout the listening area such that low frequency soundwaves and higher frequency soundwaves can be received from at least one of the speaker assemblies for most and/or key regions of the listening area. In this way, soundwaves of a particular crossover frequency from a low-range speaker located at a given position and soundwaves of the same crossover frequency from a higher-range speaker located at the same position will not form acoustically muted regions.

The speaker assembly is suspended from the ceiling or another elevated structure via the hanging element for providing audio to the listening area. This also allows the speaker assembly to be concealed or positioned so as to not draw attention thereto. The cylindrical shape of the speaker housing further diverts attention from the speaker assembly.

The upper portion of the lower section may extend upwards a selected vertical length so as to effect a desired length of the lower port channel. This may allow acoustics of the low frequency soundwaves to have a desired effect and may reduce port noise.

Another embodiment is a hanging speaker assembly broadly comprising a speaker housing, an input circuit, a low range speaker, and a higher range speaker. The speaker housing broadly comprises an upper section and a lower section for protecting the input circuit and speakers from the surrounding environment.

The upper section includes an outer shell and a plurality of ribs. The outer shell covers a top end of the lower section and encircles an upper portion of the lower section. The outer shell is vertically spaced from the top end of the lower section so as to form an upper chamber and is radially spaced from the lower section so as to form an open-ended circumferential slot.

The upper chamber redirects soundwaves from the low range speaker outward to the open-ended circumferential slot via openings between the ribs. The open-ended circumferential slot allows soundwaves from the upper chamber to pass downward along the outside of the lower section to the ambient air surrounding the hanging speaker assembly.

The lower section includes an outer wall and a lower structure. The lower section extends at least partially into the outer shell of the upper section.

The outer wall forms a primary chamber with the low range speaker being positioned in an upper end thereof. The outer wall also forms an inner boundary of the open-ended circumferential slot.

The primary chamber receives the low range speaker therein. In one embodiment, the low range speaker is positioned near a top of the primary chamber.

The lower structure partitions off a lower end of the primary chamber to form a lower chamber below the primary chamber. The lower structure also includes a number of ports connecting the primary chamber to ambient air below the hanging speaker assembly.

The upper chamber, the openings extending between the ribs, and the open-ended circumferential slot direct low frequency soundwaves from the low range speaker downward and outward from the upper section. This allows the upper chamber and hence the speaker housing to be smaller while being more effective at projecting the low frequency soundwaves.

The ports in the lower structure allow soundwaves in the primary chamber to pass downward and out of the lower section. which enhances the reproduction of the lowest frequencies generated by the woofer or subwoofer thus improving sound quality and efficiency.

Another embodiment is a speaker assembly broadly comprising a speaker housing, an acoustic dispersion plate, a plurality of legs, an input circuit, a low range speaker, and a higher range speaker. The speaker housing, input circuit, low range speaker, and higher range speaker are substantially similar to the corresponding components described above and thus will not be discussed further.

The acoustic dispersion plate supports the speaker housing and is a conical structure including an upper surface having a concave slope for redirecting downwardly traveling soundwaves emanating from at least the higher-range speaker upward and outward into the surrounding listening area. The concave slope may be hyperbolic, parabolic, circularly arcuate (i.e., a constant radius), or any other curve or combination thereof for redirecting soundwaves according to a desired distribution in the listening area. The concave slope may disperse the soundwaves (i.e., spread them out), focus the soundwaves, or effect a combination thereof according to the desired distribution. The acoustic dispersion plate may also dampen or amplify the soundwaves according to the desired amount of sound and may change the sound's quality. The acoustic dispersion plate may have a flat bottom or may have feet, mounting features, anchoring features, or other features for positioning and/or securing the speaker assembly on a floor, an elevated surface, an uneven ground, or other substantially horizontal surface.

The legs extend upward from the acoustic dispersion plate to the speaker housing so as to space the speaker housing above the acoustic dispersion plate. This allows soundwaves emanating downward from the speaker housing to reflect upward and outward from the acoustic dispersion plate into the surrounding listening area. In one embodiment, the legs include four evenly spaced legs.

Another embodiment is a wall-mount speaker assembly broadly comprising a speaker housing, an input circuit, a low range speaker, and a higher range speaker. The input circuit, low range speaker, and higher range speaker are substantially similar to the corresponding components described above and thus will not be discussed further.

The speaker housing includes a rear section and a forward section. The speaker housing has a width of between five inches and twelve inches, a height of between five inches and twelve inches, and a length of between five inches and twelve inches.

The rear section includes an outer shell and an inner wall forming a rear chamber and left and right slots. The rear chamber may be positioned behind the inner wall and in front of the back wall of the outer shell. The inner wall also forms an intermediate chamber and includes an opening connecting the rear chamber and the intermediate chamber. The outer shell also includes left and right mounting tabs.

The left and right slots extend from the rear chamber through a front wall of the forward section. The left and right slots are narrow passageways with a height equal to or greater than a height of the low range speaker. Alternatively, top and bottom slots having a width equal to or greater than a width of the low range speaker may be used. The slots increase the efficiency of the low range speaker. The efficiency is increased because the additional mass of the extra air load better matches the mass of the moving low range speaker parts, resulting in a better power transfer from the low range speaker to the air. This is similar to how impedance matching improves electrical power transfer. The increased efficiency allows the use of a smaller low range speaker and smaller chamber, which might otherwise be too large for the application.

The forward section includes a front wall having a flange extending laterally outward beyond the outer shell. The flange extends around a perimeter of the speaker housing and is configured for mounting or attaching the speaker assembly to a wall.

Another embodiment is a ceiling-mount speaker assembly broadly comprising a speaker housing, an input circuit, a low range speaker, and a higher range speaker. The input circuit, low range speaker, and higher range speaker are substantially similar to the corresponding components described above and thus will not be discussed further.

The speaker housing includes a rear (upper) section and a forward (lower) section. The speaker housing is substantially cylindrical and has a diameter of between five inches and twelve inches and a length of between five inches and twelve inches.

The rear section includes an outer shell and an inner wall forming a rear chamber and left and right slots. The rear chamber may be positioned behind the inner wall and in front of the back wall of the outer shell. The inner wall also forms an intermediate chamber and includes an opening connecting the rear chamber and the intermediate chamber. The outer shell also includes a number of mounting tabs.

The left and right slots extend from the rear chamber through a front wall of the forward section. The left and right slots are narrow passageways with a height equal to or greater than a height of the low range speaker. Alternatively, top and bottom slots having a width equal to or greater than a width of the low range speaker may be used. The slots increase the efficiency of the low range speaker. The efficiency is increased because the additional mass of the extra air load better matches the mass of the moving low range speaker parts, resulting in a better power transfer from the low range speaker to the air. This is similar to how impedance matching improves electrical power transfer. The increased efficiency allows the use of a smaller low range speaker and smaller chamber, which might otherwise be too large for the application.

The forward section includes a front wall having a flange extending laterally outward beyond the outer shell. The flange extends around a perimeter of the speaker housing and is configured for mounting or attaching the speaker assembly to a ceiling.

Another embodiment is a bookshelf or desktop speaker assembly broadly comprising a speaker housing, an input circuit, a low range speaker, and a higher range speaker. The input circuit, low range speaker, and higher range speaker are substantially similar to the corresponding components described above and thus will not be discussed further.

The speaker housing includes a rear section and a forward section. The speaker housing has a width of between five inches and twelve inches, a height of between five inches and twelve inches, and a length of between five inches and twelve inches.

The rear section includes an outer shell and an inner wall forming a rear chamber and left and right slots. The rear chamber may be positioned behind the inner wall and in front of the back wall of the outer shell. The inner wall also forms an intermediate chamber and includes an opening connecting the rear chamber and the intermediate chamber.

The left and right slots extend from the rear chamber through a front wall of the forward section. The left and right slots are narrow passageways with a height equal to or greater than a height of the low range speaker. Alternatively, top and bottom slots having a width equal to or greater than a width of the low range speaker may be used. The slots increase the efficiency of the low range speaker. The efficiency is increased because the additional mass of the extra air load better matches the mass of the moving low range speaker parts, resulting in a better power transfer from the low range speaker to the air. This is similar to how impedance matching improves electrical power transfer. The increased efficiency allows the use of a smaller low range speaker and smaller chamber, which might otherwise be too large for the application.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
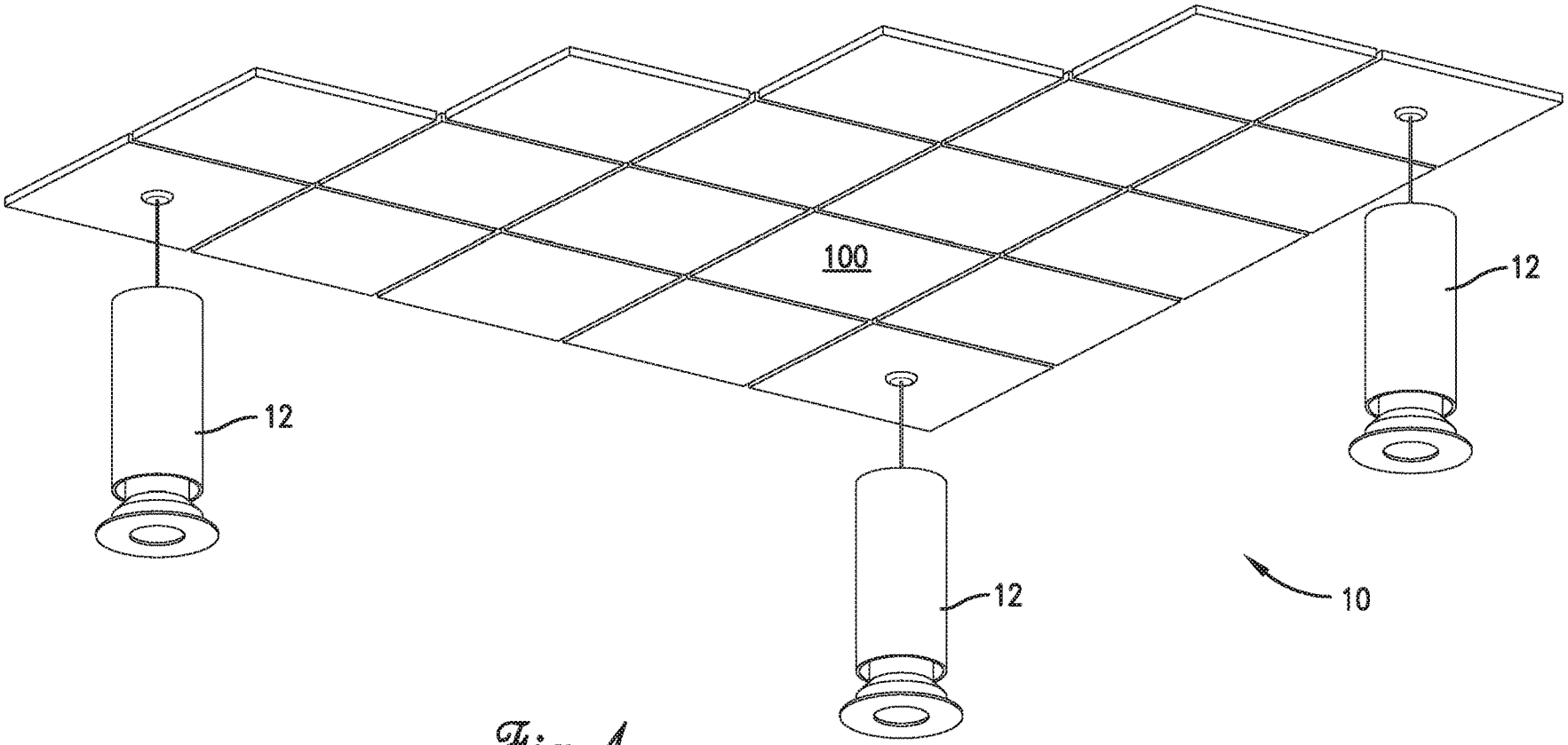
FIG. 1 is an environmental view of a speaker system constructed in accordance with an embodiment of the invention and including a number of speaker assemblies.
Figure 2:
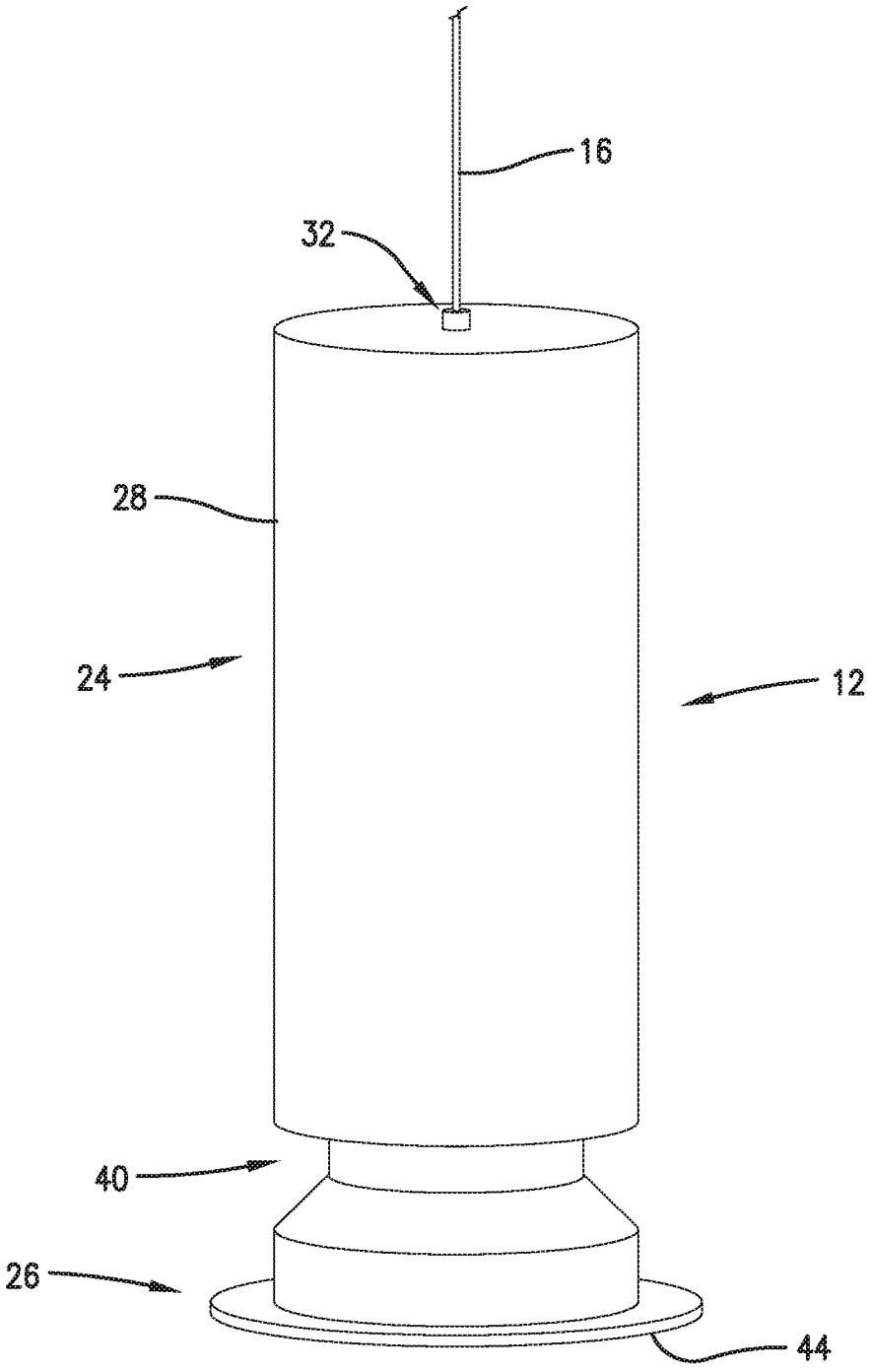
FIG. 2 is a perspective view of one speaker assembly of the speaker system shown in FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning FIGS. 1-5, a hanging speaker system 10 constructed in accordance with an embodiment of the invention is illustrated. The hanging speaker system 10 broadly comprises a number of speaker assemblies 12 configured to be spaced apart from each other and hung from a ceiling 100 or other elevated structure to form a listening area. The speaker assemblies 12 may be communicatively connected to a sound system 102 such as an audio receiver, radio tuner, amplifier, mixer, computer, mobile computing device, portable music player, or any other suitable audio-capable electronic device via wires or wireless communication technology such as an internet connection, Bluetooth connection, radio frequency connection, cellular network, near field communication connection, or any other suitable wireless connection.

Embodiments of the speaker assemblies 12 will now be described in more detail. The speaker assemblies 12 each broadly comprise a speaker housing 14, a hanging component 16, an input circuit 18, a low range speaker 20, and a higher-range speaker 22.

Figure 3:
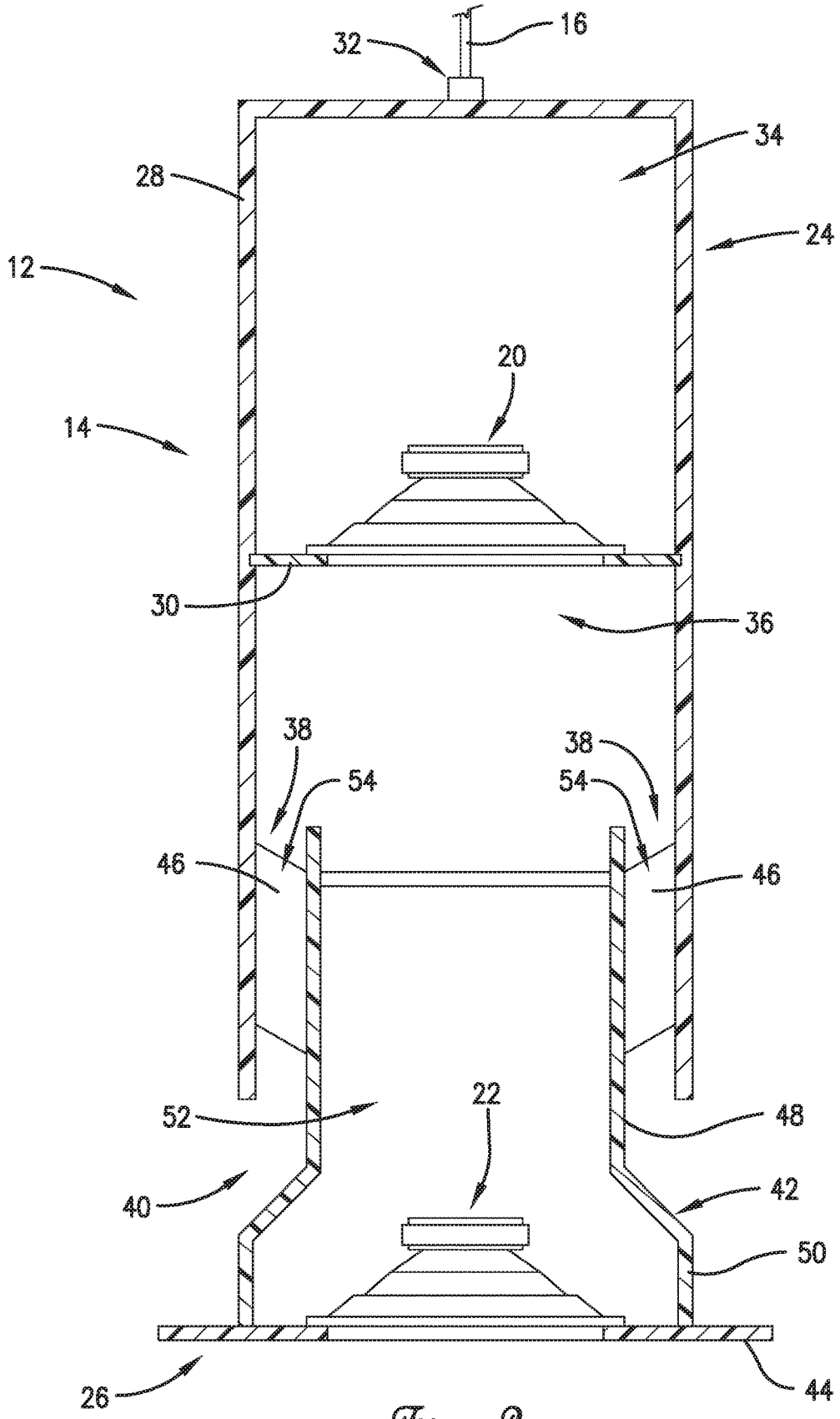
FIG. 3 is a cutaway elevation view of the speaker assembly of FIG. 2.
Figure 4:
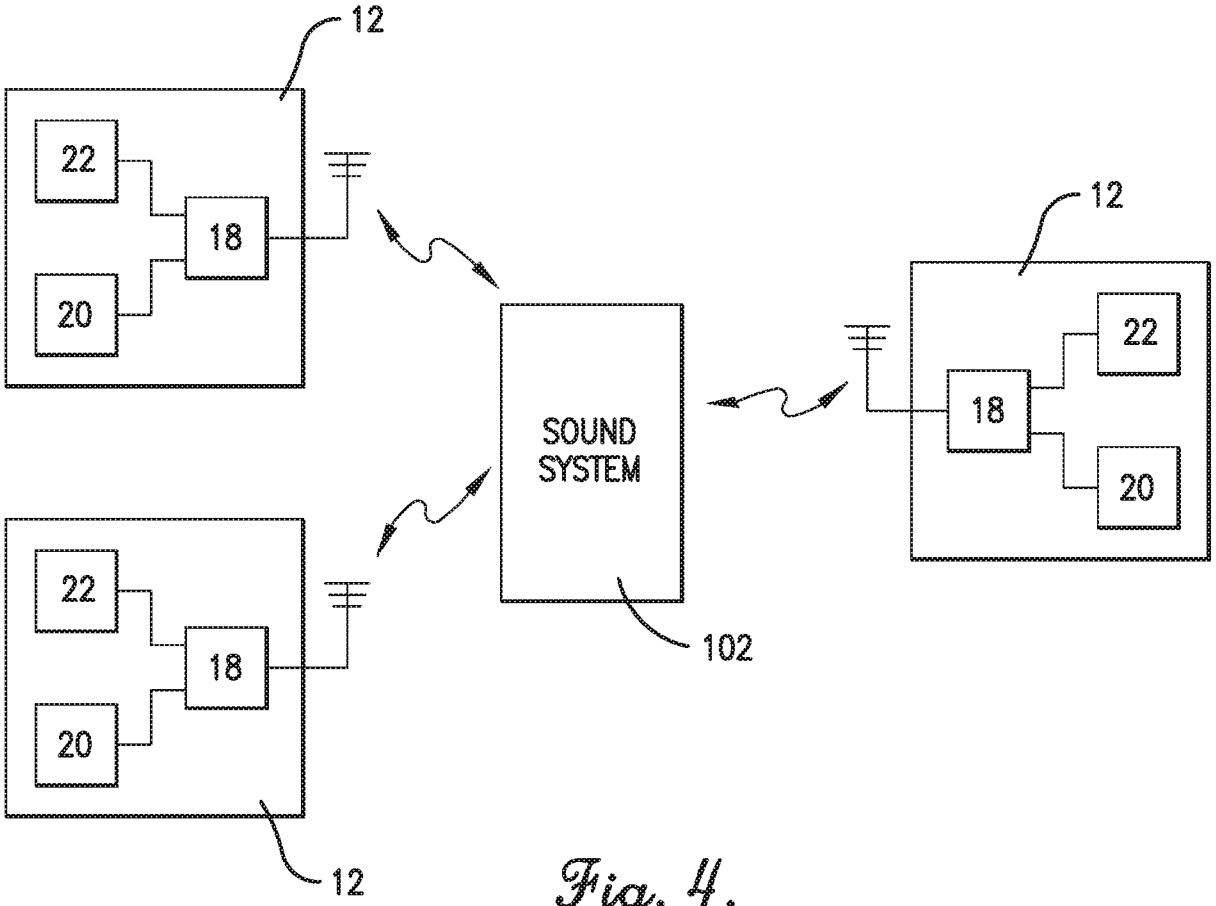
FIG. 4 is a schematic diagram of the speaker system of FIG. 1 in wireless communication with a sound system in accordance with another embodiment of the invention.
Figure 5:
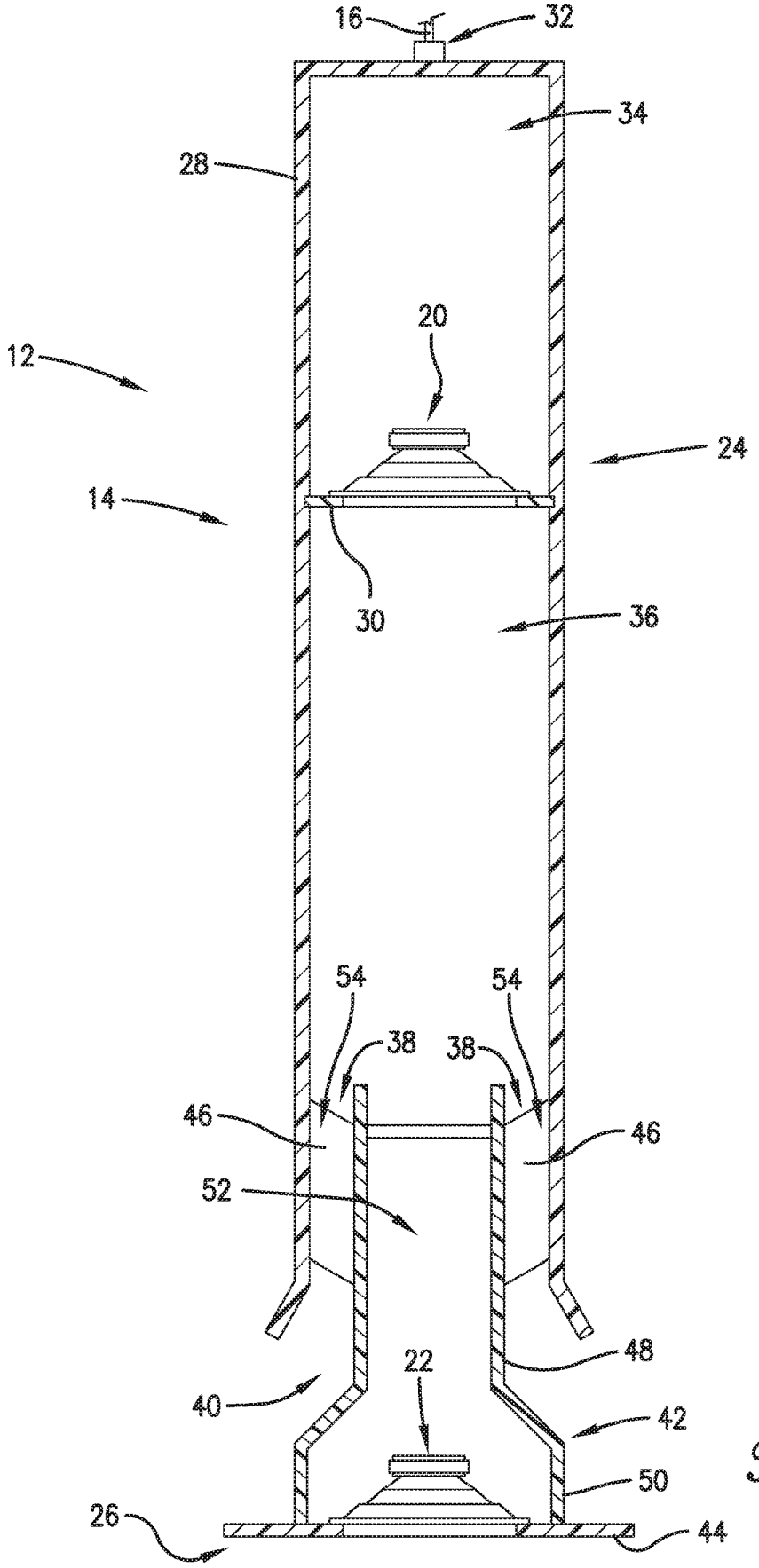
FIG. 5 is a cutaway elevation view of a speaker assembly constructed in accordance with another embodiment of the invention.

The speaker housing 14 protects the input circuit 18 and speakers 20, 22 from the environment and broadly comprises an upper section 24 and a lower section 26. In one embodiment, the speaker housing 14 may have an outer diameter of between five inches and twelve inches (not including the baffle described below) and a height of between approximately twenty inches and approximately forty inches. In one embodiment, the speaker housing 14 has an outer diameter of approximately ten inches and a height of approximately twenty-seven inches (FIG. 3). In another embodiment, the speaker housing 26 has an outer diameter of approximately six inches and a height of approximately thirty-seven inches (FIG. 5). The small diameter of the speaker housing 14 allows the speaker assembly 12 to be less conspicuous and may allow the speaker assembly 12 to be positioned in narrow spaces.

The upper section 24 encloses the low range speaker 20 and broadly comprises an outer wall 28, a divider 30, and a connector 32. The outer wall 28 defines an upper chamber 34 and a lower chamber 36. The outer wall 28 may have a thickness of between approximately one eighth of an inch and approximately three fourths of an inch. In one embodiment, a lower end of the outer wall 28 may be flared radially outward slightly (FIG. 5), the purpose of which will be described below. The outer wall 28 may have an outer diameter of between approximately five inches and approximately twelve inches. In one embodiment, the outer wall 28 has an outer diameter of approximately ten inches (FIG. 3). In another embodiment, the outer wall 28 has an outer diameter of approximately six inches (FIG. 5). The upper section 24 may be formed of PVC or other plastic, metal, or any other suitable material and may be waterproof and/or corrosion resistant.

The upper chamber 34 retains the low-range speaker 20 therein and may be acoustically shaped for projecting low frequency soundwaves generated by the low-range speaker 20 downwards and/or outwards. To that end, the outer wall 28 may be cylindrical, orthogonal, spherical, or any other suitable shape. The upper chamber 34 may also have any suitable size for optimizing the reproduction of desired low frequency soundwaves therefrom.

The lower chamber 36 encircles the lower section 26 and allows low frequency soundwaves generated by the low range speaker 20 to pass out of the speaker housing 14 via a lower port channel 38 and a lower port exit 40. The lower chamber 36 may be acoustically shaped for projecting low frequency soundwaves generated by the low range speaker 20 downwards through the lower port channel 38 and outwards through the lower port exit 40. To that end, the outer wall 28 may be cylindrical, orthogonal, spherical, or any other suitable shape. The lower chamber 36 may also have any suitable size for optimizing the projection of desired low frequency soundwaves therefrom.

The divider 30 extends horizontally in the upper section 24 and partitions the upper section 24 into the upper chamber 34 and the lower chamber 36. The divider 30 also supports the low-range speaker 20 such that the low-range speaker 20 is spaced from a top of the upper section 24. The divider 30 may be spaced from the top of the upper section 24 between approximately six inches and approximately fifteen inches and spaced from a top of the lower section 26 between approximately three inches and approximately fifteen inches. In one embodiment, the divider 30 is spaced approximately six inches from the top of the upper section 24 and spaced approximately seven inches from the top of the lower section 26. That is, the divider 30 may be positioned any suitable height below the top of the upper section 24 and above the top of the lower section 26 for optimizing the reproduction of desired low frequency soundwaves from the upper chamber 34 and lower chamber 36.

The connector 32 secures the hanging component 16 to the speaker housing 14 and may be positioned near a middle of the top of the upper section 24 so that the speaker assembly 12 is balanced and oriented vertically upright when hanging from the ceiling 100. The connector 32 may be integrally formed into the outer wall 28 of the upper section 24 such as a molded connection boss. The connector 32 may be an anchor, a hook, a fastener, or any other connecting feature.

The lower section 26 houses the higher-range speaker 22 and broadly comprises an outer wall 42, a baffle 44, and a plurality of vanes 46. The outer wall 42 includes an upper portion 48 and a lower portion 50 and forms an inner chamber 52. The lower section 26 and the outer wall 28 cooperatively form the lower port exit 40.

The upper portion 48 may be nested in the lower chamber 36 of the upper section 24 and thus may have a smaller outer diameter than an inner diameter of the outer wall 28. In some embodiments, the upper portion 48 may have a smaller outer diameter than an outer diameter of the lower portion 50. The upper portion 48 may extend upwards a selected vertical length so as to effect a desired length of the lower port channel 38. This optimizes low frequency output. To that end, if a cross section area of the lower port channel 38 and/or the lower port exit 40 is increased, the length of the lower port channel 38 should be increased. Likewise, if the cross section area of the lower port channel 38 and/or the lower port exit 40 is decreased, the length of the lower port channel 38 should be decreased. Meanwhile, decreasing the cross section area of the lower port exit 40 increases air velocity therethrough, which may cause port noise. Thus, the lower end of the outer wall 28 of the upper section 24 near the lower port exit 40 may be flared radially outward slightly (FIG. 5) so as to increase the cross section area of the lower port exit 40 and thereby reduce port noise. A longer flare provides more port noise mitigation.

The lower portion 50 may have an outer diameter substantially equal to the outer diameter of the outer wall 28 so that the lower portion 50 and the outer wall 28 appear essentially as vertical extensions of each other separated by the lower port exit 40. That is, the lower portion 50 may have a diameter of between approximately five inches and approximately twelve inches. In one embodiment, the lower portion 50 has an outer diameter of approximately ten inches (FIG. 3). In another embodiment, the lower portion 50 has an outer diameter of approximately six inches (FIG. 5). Alternatively, the lower portion 50 may have a diameter smaller or greater than the diameter of the outer wall 28.

The inner chamber 52 encloses the higher range speaker 26 therein. To that end, the inner chamber 52 may be cylindrical, orthogonal, spherical, bell-shaped, or any other suitable shape.

The baffle 44 at least partially encloses the inner chamber 52 of the lower section 26 and may extend radially beyond the lower portion 50. That is, the baffle 44 may have a diameter greater than the diameter of the lower portion 50. The baffle 44 may be sound permeable or may have a number of openings for allowing higher frequency soundwaves from the higher-range speaker 22 to pass out of the inner chamber 52. The baffle 44 concentrates higher frequency soundwaves below the speaker assembly 12. The baffle 44 may be a cover, a plate, or any other suitable enclosing structure.

The vanes 46 extend radially outward from the upper portion 48 of the outer wall 42 of the lower section 26 to the outer wall 28 of the upper section so as to connect the lower section 26 to the upper section 24. While the vanes 46 are described herein as being part of the lower section 26 and configured to be connected to the upper section 24, the vanes 46 may alternatively be part of the upper section 24 and configured to be connected to the lower section 26. The vanes 46 also divide the lower port channel 38 into a plurality of radial spaces 54. The radial spaces 54 are vertically extending pathways through which low frequency soundwaves from the low-range speaker 20 may pass from the lower chamber 36 to the lower port exit 40. Each radial space 54 may be bounded by part of the upper portion 48, adjacent vanes, and part of the outer wall 28 of the upper section 24.

The hanging component 16 suspends the speaker assembly 12 from the ceiling 100 or other elevated structure. To that end, the hanging component 16 may be secured to an anchor or other mounting feature of the ceiling 100 near its upper end and secured to the connector 32 at its lower end. The hanging component 16 may support or house electrical or electronic wiring connected between the input circuit 18 and the sound system 102 and/or a power source. The hanging component 16 may be a cable, a chain, a wire, a rope, a rigid member, or any other suitable structure. Alternatively, the speaker housing 14 may be mounted directly to the ceiling 100 or other elevated structure.

The input circuit 18 receives audio signals from the sound system 102 and actively or passively sends the audio signals to the speakers 20, 22. The input circuit 18 may include an antenna, data bus, data port, or any other suitable communication component, an amplifier, a mixer, or any other suitable sound manipulation component. The input circuit 16 may be positioned in the upper section 24, the lower section 26, or any other location for improving signal reception.

The low range speaker 20 generates low frequency soundwaves and may be positioned in or mounted to the divider 30. The low range speaker 20 may be aimed upwards or downwards for projecting the low frequency soundwaves through the lower port channel 38 (via the radial spaces 54) and out the lower port exit 40. The low range speaker 20 may be a woofer, subwoofer, bass speaker, or other low-range speaker.

The higher-range speaker 22 generates higher frequency soundwaves and may be positioned in or mounted to the baffle 44. The higher-range speaker 22 is aimed downwards for projecting higher frequencies. The higher-range speaker 22 may be a full range speaker, a woofer with a tweeter, a woofer with a midrange and tweeter, or any other similar speaker or combination of speakers.

Use of the above-described speaker system 10 will now be described in more detail. First, the speaker assemblies 12 may be spaced apart from each other throughout the listening area such that low frequency soundwaves and higher frequency soundwaves can be received from at least one of the speaker assemblies 12 for most and/or key regions of the listening area. In this way, soundwaves of a particular crossover frequency from a low-range speaker located at a given position and soundwaves of the same crossover frequency from a higher-range speaker located at the same position will not form acoustically muted regions.

The speaker assemblies 12 may be suspended from the ceiling 100 or another elevated structure via the hanging elements 16 for providing audio to a room, an indoor or outdoor shopping space, a pavilion, or any other suitable area. The speaker assemblies 12 can be concealed or inconspicuously positioned so as to not draw attention to them. The cylindrical shape of the speaker housings 14 further diverts attention from the speaker assemblies 12.

The upper portion 48 may extend upwards a selected vertical length so as to effect a desired length of the lower port channel 38. This may allow acoustics of the low frequency soundwaves to have a desired effect and may reduce port noise.

Figure 6:
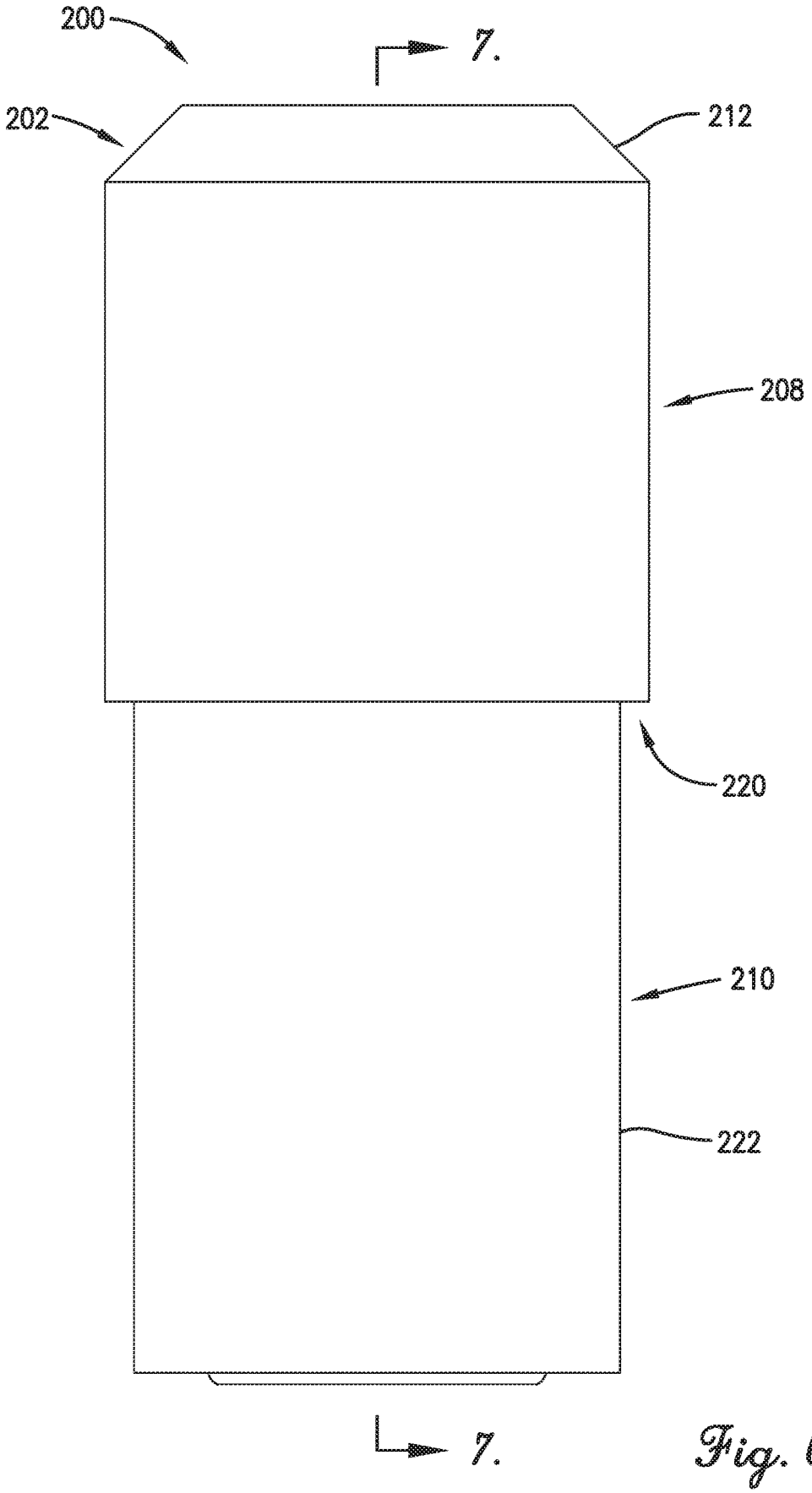
FIG. 6 is an elevation view of a speaker assembly constructed in accordance with another embodiment of the invention.
Figure 7:
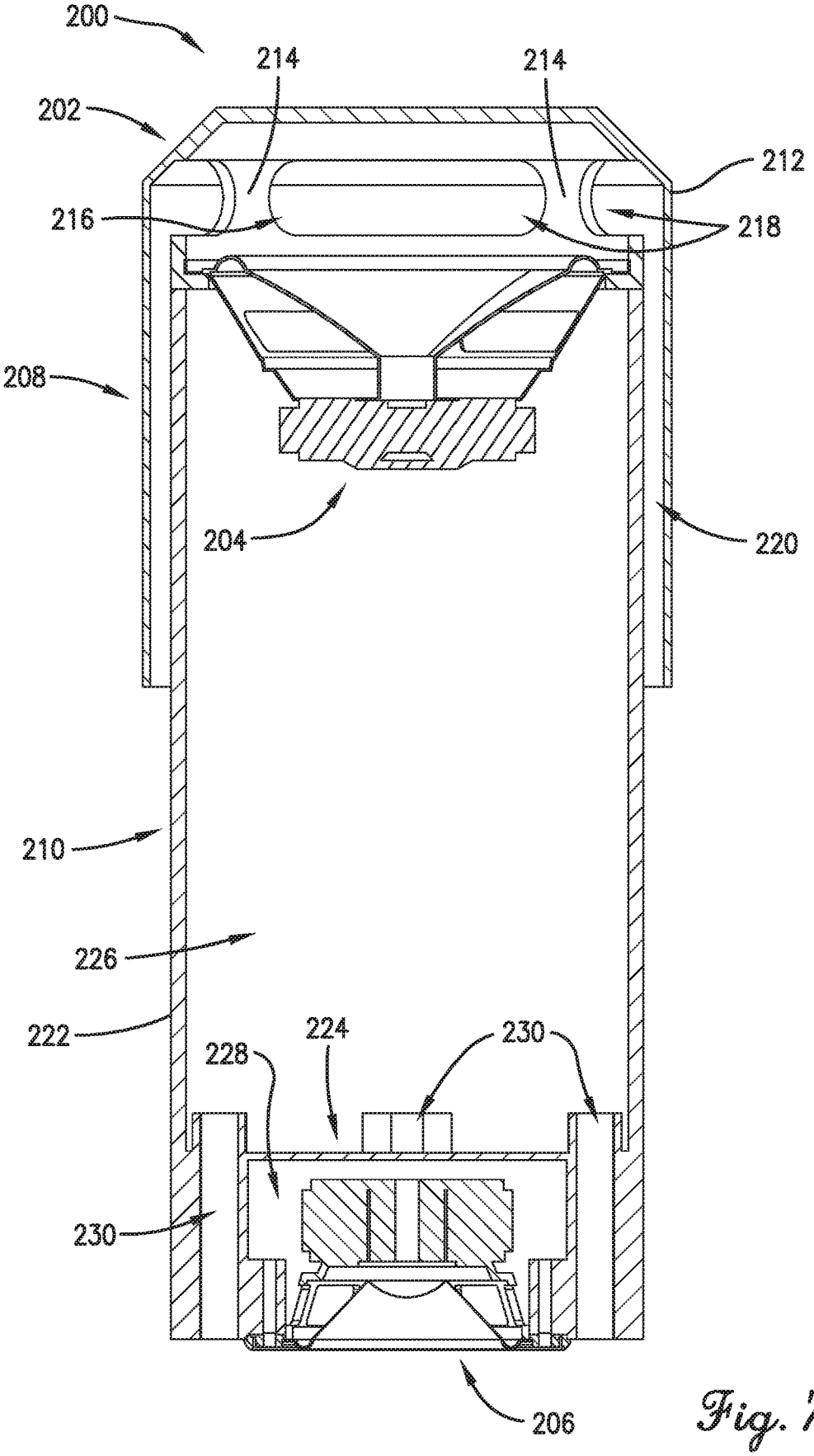
FIG. 7 is a cutaway elevation view of the speaker assembly of FIG. 6.
Figure 8:
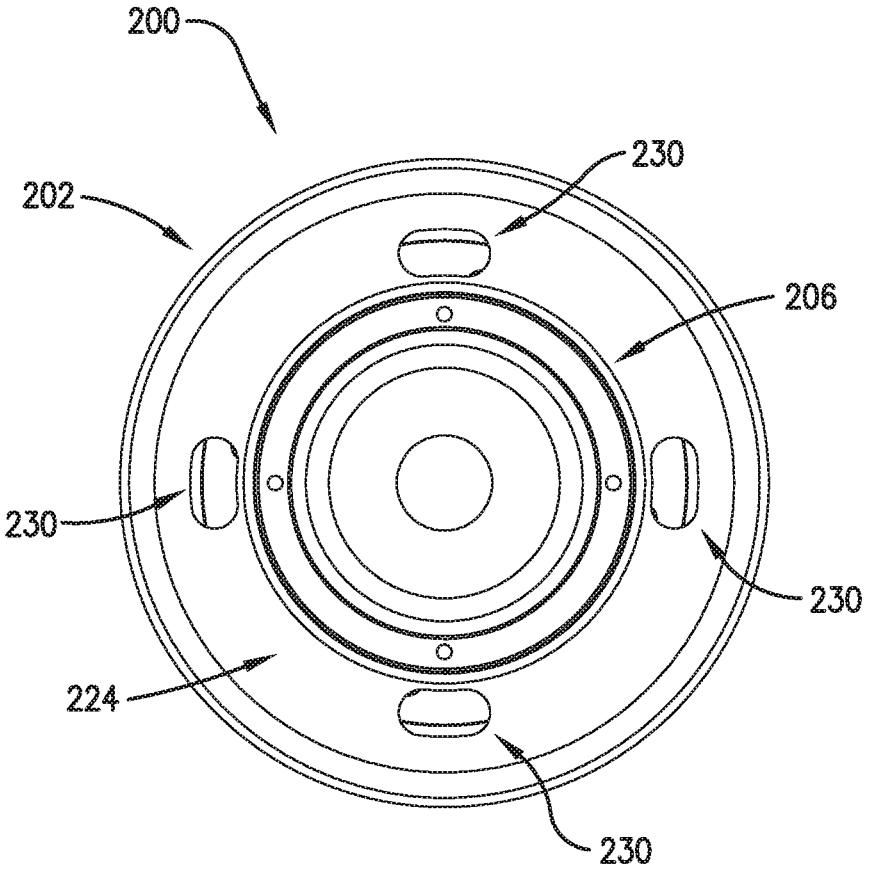
FIG. 8 is a bottom plan view of the speaker assembly of FIG. 6.

Turning to FIGS. 6-8, a hanging speaker assembly 200 constructed in accordance with another embodiment of the invention is illustrated. The hanging speaker assembly 200 broadly comprises a speaker housing 202, an input circuit, a low range speaker 204, and a higher range speaker 206.

The speaker housing 202 broadly comprises an upper section 208 and a lower section 210 for protecting the input circuit and speakers 204, 206 from the surrounding environment. In one embodiment, the speaker housing 202 may have an outer diameter of between five inches and twelve inches and a height of approximately forty inches. In another embodiment, the speaker housing 202 has an outer diameter of approximately ten inches and a height of approximately twenty-seven inches.

The upper section 208 includes an outer shell 212 and a plurality of ribs 214. The outer shell 212 covers a top end of the lower section 210 and encircles an upper portion of the lower section 210. The outer shell 212 is vertically spaced from the top end of the lower section 210 so as to form an upper chamber 216 and is radially spaced from the lower section 210 so as to form an open-ended circumferential slot 220. The outer shell 212 may be angled, tapered, chamfered, radiused, or filleted near an upper perimeter thereof.

The upper chamber 216 redirects soundwaves from the low range speaker 204 outward to the open-ended circumferential slot 220 via openings 218 between the ribs 214. The open-ended circumferential slot 220 allows soundwaves from the upper chamber 216 to pass downward along the outside of the lower section 210 to the ambient air around the hanging speaker assembly 200. The angled, tapered, chamfered, radiused, or filleted shape of the outer shell 212 may improve soundwave redirection from the upper chamber 216 to the open-ended circumferential slot 220.

The ribs 214 connect the upper section 208 to the lower section 210 and space the upper section 208 above the top end of the lower section 210. The ribs 214 are also spaced from each other so as to form the openings 218 therebetween. The openings 218 allow soundwaves to pass from the upper chamber 216 to the open-ended circumferential slot 220. In one embodiment, the ribs 214 include four equally-spaced ribs.

The lower section 210 includes an outer wall 222 and a lower structure 224. The lower section 210 extends at least partially into the outer shell 212 of the upper section 208 and may be substantially cylindrical.

The outer wall 222 forms a primary chamber 226 with the low range speaker 204 being positioned in an upper end thereof. The outer wall 222 also forms an inner boundary of the open-ended circumferential slot 220.

The lower structure 224 partitions off a lower end of the primary chamber 226 to form a lower chamber 228 below the primary chamber 226. The lower chamber 228 may be sealed or may be ported. The lower structure 224 also includes a number of ports 230 connecting the primary chamber 226 to ambient air below the hanging speaker assembly 200. In one embodiment, the ports 230 include four ports evenly spaced from each other circumferentially around the lower chamber 228.

The input circuit receives audio signals from a sound system and actively or passively sends the audio signals to the speakers 204, 206. The input circuit may be substantially similar to the input circuit described above. That is, the input circuit may include an antenna, data bus, data port, or any other suitable communication component, an amplifier, a mixer, or any other suitable sound manipulation component. The input circuit may be positioned in the upper section 208, the lower section 210, or any other location for improving signal reception.

The low range speaker 204 generates low frequency soundwaves and may be positioned near a top end of the primary chamber 226. The low range speaker 204 may be attached to mounting structure of the upper section 208 or lower section 210 and may face upward to project soundwaves into the upper chamber 216. The low range speaker 204 may be a woofer, subwoofer, bass speaker, or other low-range speaker.

The higher range speaker 206 generates higher frequency soundwaves instead of or in addition to low frequency soundwaves and may be positioned in the lower chamber 228. The higher range speaker 206 may face downward for projecting soundwaves to the ambient air below the hanging speaker assembly 200. The higher range speaker 206 may be a full range speaker, a woofer with a tweeter, a woofer with a midrange and tweeter, or any other similar speaker or combination of speakers.

Use of the above-described hanging speaker assembly 200 will now be described in more detail. First, the hanging speaker assembly 200 may be spaced apart from other hanging speaker assemblies throughout a listening area such that low frequency soundwaves and higher frequency soundwaves can be received from at least one hanging speaker assembly for most and/or key regions of the listening area. In this way, soundwaves of a particular crossover frequency from a low range speaker locate at a given position and soundwaves of the same crossover frequency from a full range speaker (or a higher-range speaker) located at the same position will not form acoustically muted regions.

The hanging speaker assembly 200 may be suspended from a ceiling or another elevated structure via hanging elements for providing audio to a room, an indoor or outdoor shopping space, a pavilion, or any other suitable area. The hanging speaker assembly 200 can be concealed or inconspicuously positioned so as to not draw attention to it. The cylindrical shape of the speaker housing 202 further diverts attention from the hanging speaker assembly 200.

The upper chamber 216, the openings 218 extending between the ribs 214, and the open-ended circumferential slot 220 direct low frequency soundwaves from the low range speaker downward and outward from the upper section 208. This allows the upper chamber 216 and hence the speaker housing 202 to be smaller while being more effective at projecting the low frequency soundwaves.

The ports 230 in the lower structure 224 allow soundwaves in the primary chamber to pass downward and out of the lower section 210, which enhances the reproduction of the lowest frequencies generated by the woofer or subwoofer, thus improving sound quality and efficiency.

Figures 9, 10, 11:
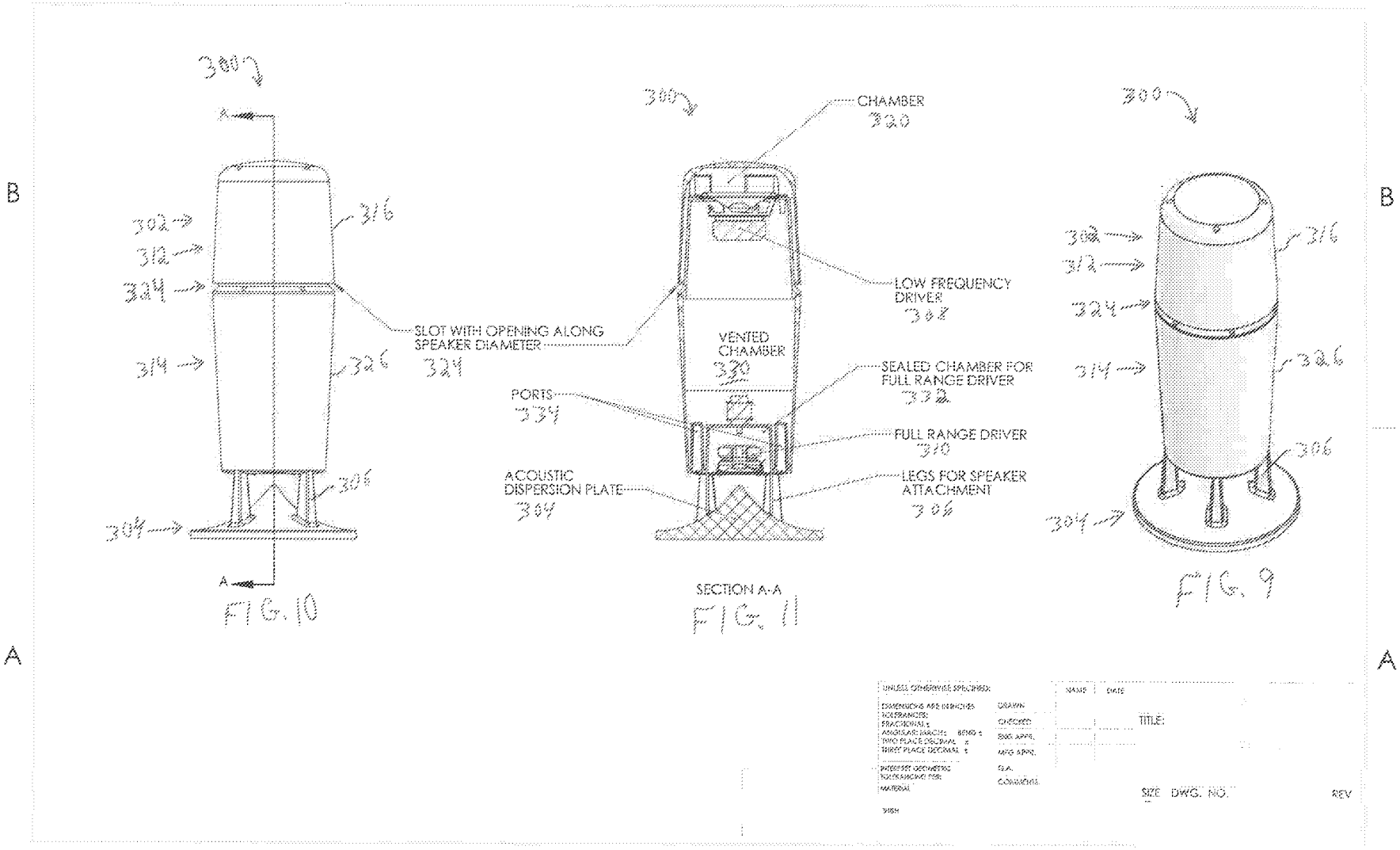
FIG. 9 is a perspective view of a speaker assembly constructed in accordance with another embodiment of the invention.
FIG. 10 is an elevation view of the speaker assembly of FIG. 9.
FIG. 11 is a cutaway elevation view of the speaker assembly of FIG. 10.

Turning to FIGS. 9-11, a speaker assembly 300 constructed in accordance with another embodiment of the invention is illustrated. The speaker assembly 300 broadly comprises a speaker housing 302, an acoustic dispersion plate 304, a plurality of legs 306, an input circuit, a low range speaker 308, and a higher range speaker 310.

The speaker housing 302 broadly comprises an upper section 312 and a lower section 314 for protecting the input circuit and the speakers 308, 310 from the surrounding environment. In one embodiment, the speaker housing 302 may have an outer diameter of between five inches and twelve inches and a height of approximately forty inches. In another embodiment, the speaker housing 302 has an outer diameter of approximately ten inches and a height of approximately twenty-seven inches.

The upper section 312 includes an outer shell 316 and a plurality of ribs. The outer shell 316 covers a top end of the lower section 314 and encircles an upper portion of the lower section 314. The outer shell 316 is vertically spaced from the top end of the lower section 314 so as to form an upper chamber 320 and is radially spaced from the lower section 314 so as to form an open-ended circumferential slot 320. The outer shell 316 may be angled, tapered, chamfered, radiused, or filleted near an upper perimeter thereof.

The upper chamber 320 redirects soundwaves from the low range speaker 308 outward to the open-ended circumferential slot 320 via openings between the ribs. The open-ended circumferential slot 320 allows soundwaves from the upper chamber 320 to pass downward along the outside of the lower section 314 to the ambient air around the speaker assembly 300. The angled, tapered, chamfered, radiused, or filleted shape of the outer shell 316 may improve soundwave redirection from the upper chamber 320 to the open-ended circumferential slot 320.

The ribs connect the upper section 312 to the lower section 314 and space the upper section 312 above the top end of the lower section 314. The ribs are also spaced from the each other so as to form the openings therebetween. The openings allow soundwaves to pass from the upper chamber 320 to the open-ended circumferential slot 324. In one embodiment, the ribs include four equally-spaced ribs.

The lower section 314 includes an outer wall 326 and a lower structure 328. The lower section 314 extends at least partially into the outer shell 316 of the upper section 312 and may be substantially cylindrical.

The outer wall 326 forms a primary chamber 330 with the low range speaker 308 being positioned in an upper end thereof. The outer wall 326 also forms an inner boundary of the open-ended circumferential slot 320.

The lower structure 328 partitions off a lower end of the primary chamber 330 to form a lower chamber 332 below the primary chamber 330. The lower chamber 332 may be sealed or may be ported. The lower structure 328 also includes a number of ports 334 connecting the primary chamber 330 to ambient air below the speaker assembly 300. In one embodiment, the ports 334 include four ports evenly spaced from each other circumferentially around the lower chamber 332.

The acoustic dispersion plate 304 supports the speaker housing 302 and may be a conical structure including an upper surface having a concave slope for redirecting downwardly traveling soundwaves from at least the higher-range speaker upward and outward. The concave slope may be hyperbolic, parabolic, circularly arcuate (i.e., a constant radius), or any other curve or combination thereof for redirecting soundwaves according to a desired distribution in the listening area. The concave slope may disperse the soundwaves (i.e., spread them out), focus the soundwaves, or effect a combination thereof according to the desired distribution. The acoustic dispersion plate 304 may also dampen or amplify the soundwaves according to the desired amount of sound and may change the sound's quality. The acoustic dispersion plate 304 may have a flat bottom or may have feet, mounting features, anchoring features, or other features for positioning and/or securing the speaker assembly 300 on a floor, an elevated surface, an uneven ground, or other substantially horizontal surface.

The legs 306 extend upward from the acoustic dispersion plate 304 to the speaker housing 302. As such, the legs 306 space the speaker housing 302 above the acoustic dispersion plate 304 to allow soundwaves emanating downward from the speaker housing 302 to reflect upward and outward from the acoustic dispersion plate 304 into the surrounding listening area. In one embodiment, the legs 306 include four evenly spaced legs.

The input circuit receives audio signals from a sound system and actively or passively sends the audio signals to the speakers 308, 310. The input circuit may be substantially similar to the input circuits described above. That is, the input circuit may include an antenna, data bus, data port, or any other suitable communication component, an amplifier, a mixer, or any other suitable sound manipulation component. The input circuit may be positioned in the upper section 312, the lower section 314, or any other location for improving signal reception.

The low range speaker 308 generates low frequency soundwaves and may be positioned near a top end of the primary chamber 330. The low range speaker 308 may be attached to mounting structure of the upper section 312 or lower section 314 and may face upward to project soundwaves into the upper chamber 320. The low range speaker 308 may be a woofer, subwoofer, bass speaker, or other low-range speaker.

The higher range speaker 310 generates higher frequency soundwaves instead of or in addition to low frequency soundwaves and may be positioned in the lower chamber 332. The higher range speaker 310 may face downward for projecting soundwaves to the ambient air below the speaker assembly 300 (to be redirected by the acoustic dispersion plate 304. The higher range speaker 310 may be a full range speaker, a woofer with a tweeter, a woofer with a midrange and tweeter, or any other similar speaker or combination of speakers.

Use of the above-described speaker assembly 300 will now be described in more detail. The speaker assembly 300 may be spaced apart from other speaker assemblies throughout a listening area such that low frequency soundwaves and higher frequency soundwaves can be received from at least one speaker assembly for most and/or key regions of the listening area. In this way, soundwaves of a particular crossover frequency from a low range speaker locate at a given position and soundwaves of the same crossover frequency from a full range speaker (or a higher-range speaker) located at the same position will not form acoustically muted regions.

The speaker assembly 300 may be positioned and/or mounted on a floor, a ground surface, an elevated surface, or the like for providing audio to a room, an indoor or outdoor shopping space, a pavilion, or any other suitable area. The speaker assembly 300 can be concealed or inconspicuously positioned so as to not draw attention to it. The cylindrical shape of the speaker housing 302 further diverts attention from the speaker assembly 300.

The upper chamber 320, the openings extending between the ribs, and the open-ended circumferential slot 324 direct low frequency soundwaves from the low range speaker downward and outward from the upper section 312. This allows the upper chamber 320 and hence the speaker housing 302 to be smaller while being more effective at projecting the low frequency soundwaves.

The ports 334 in the lower structure 328 allow soundwaves in the primary chamber to pass downward and out of the lower section 314, which enhances the reproduction of the lowest frequencies generated by the woofer or subwoofer, thus improving sound quality and efficiency.

The acoustic dispersion plate 304 redirects downwardly traveling soundwaves from the higher-range speaker 310 and/or the low range speaker 308 upward and outward into the listening area. This provides a more optimal distribution of acoustic energy in the listening area.

Figure 12:
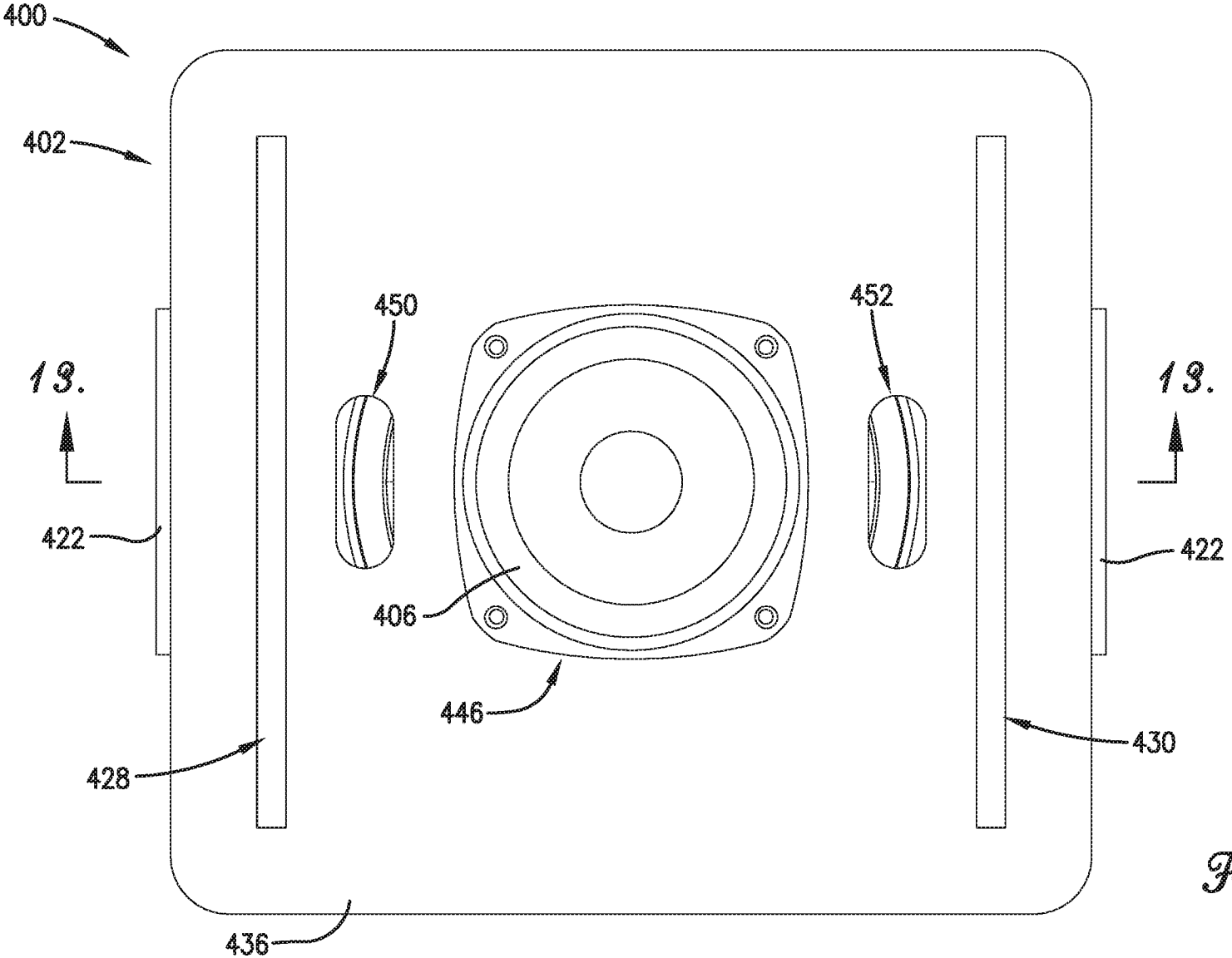
FIG. 12 is a front elevation view of a speaker assembly constructed in accordance with another embodiment of the invention.
Figure 13:
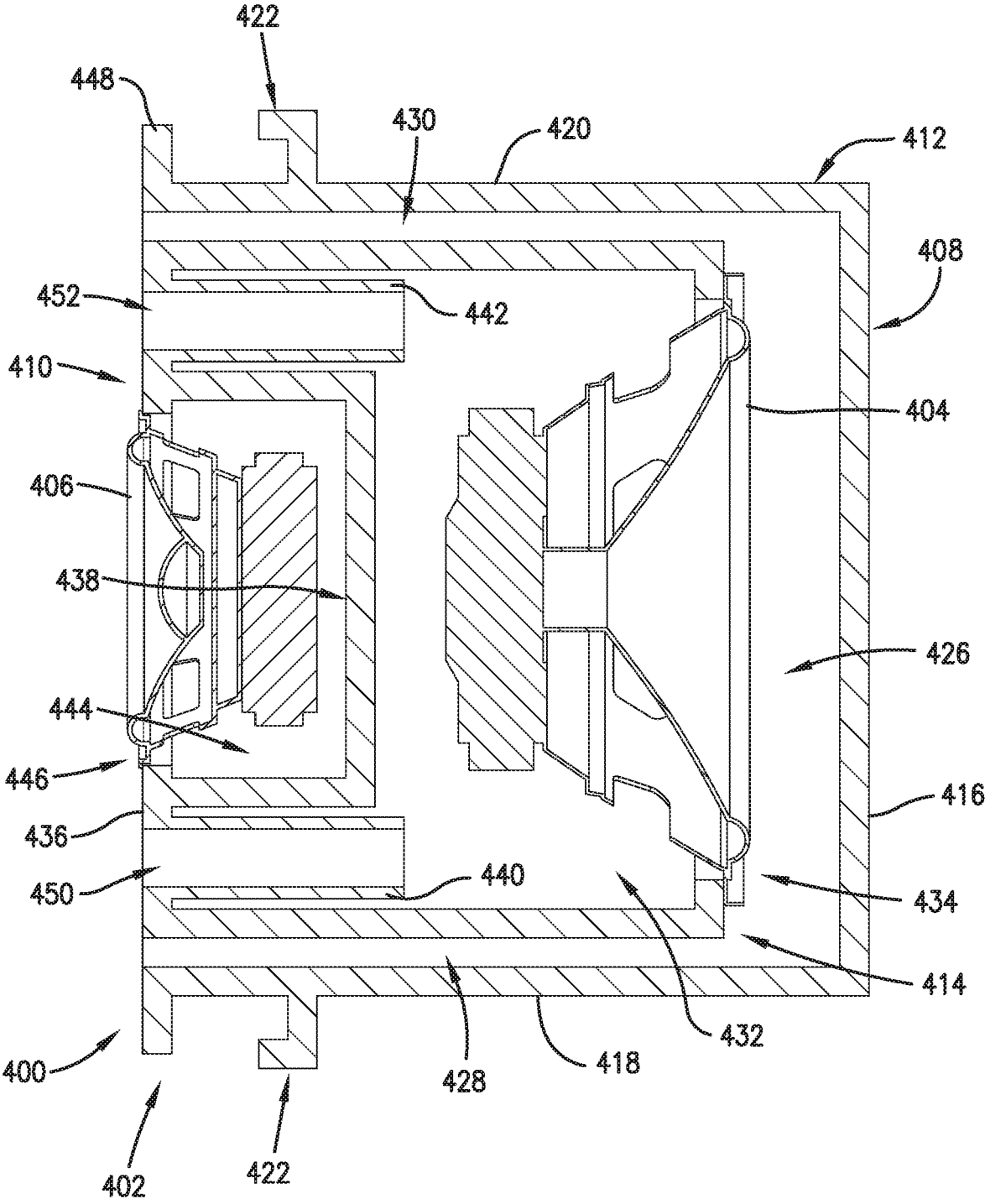
FIG. 13 is a cutaway bottom plan view of the speaker assembly of FIG. 12.
Figure 14:
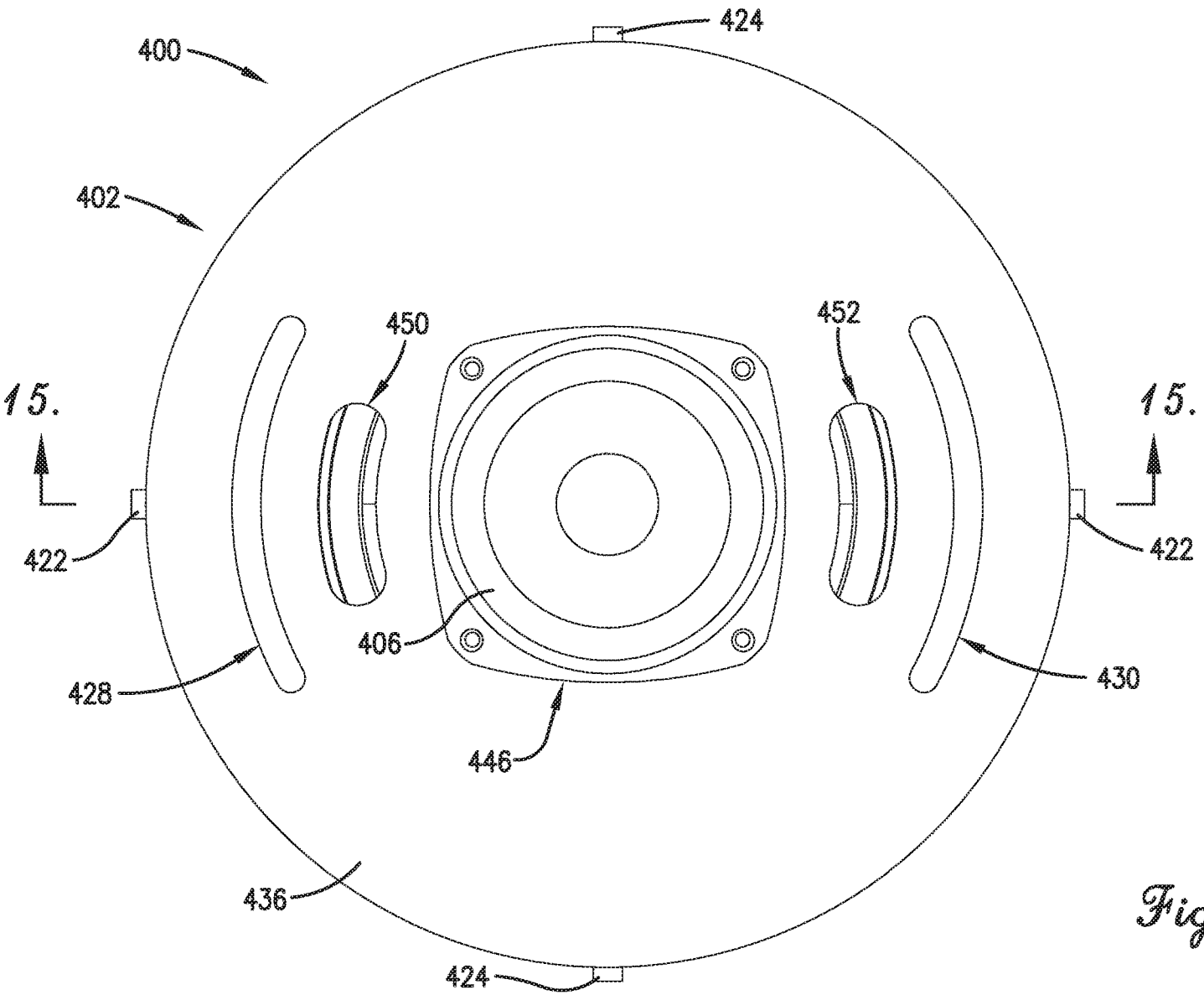
FIG. 14 is a bottom plan of a speaker assembly constructed in accordance with another embodiment of the invention.
Figure 15:
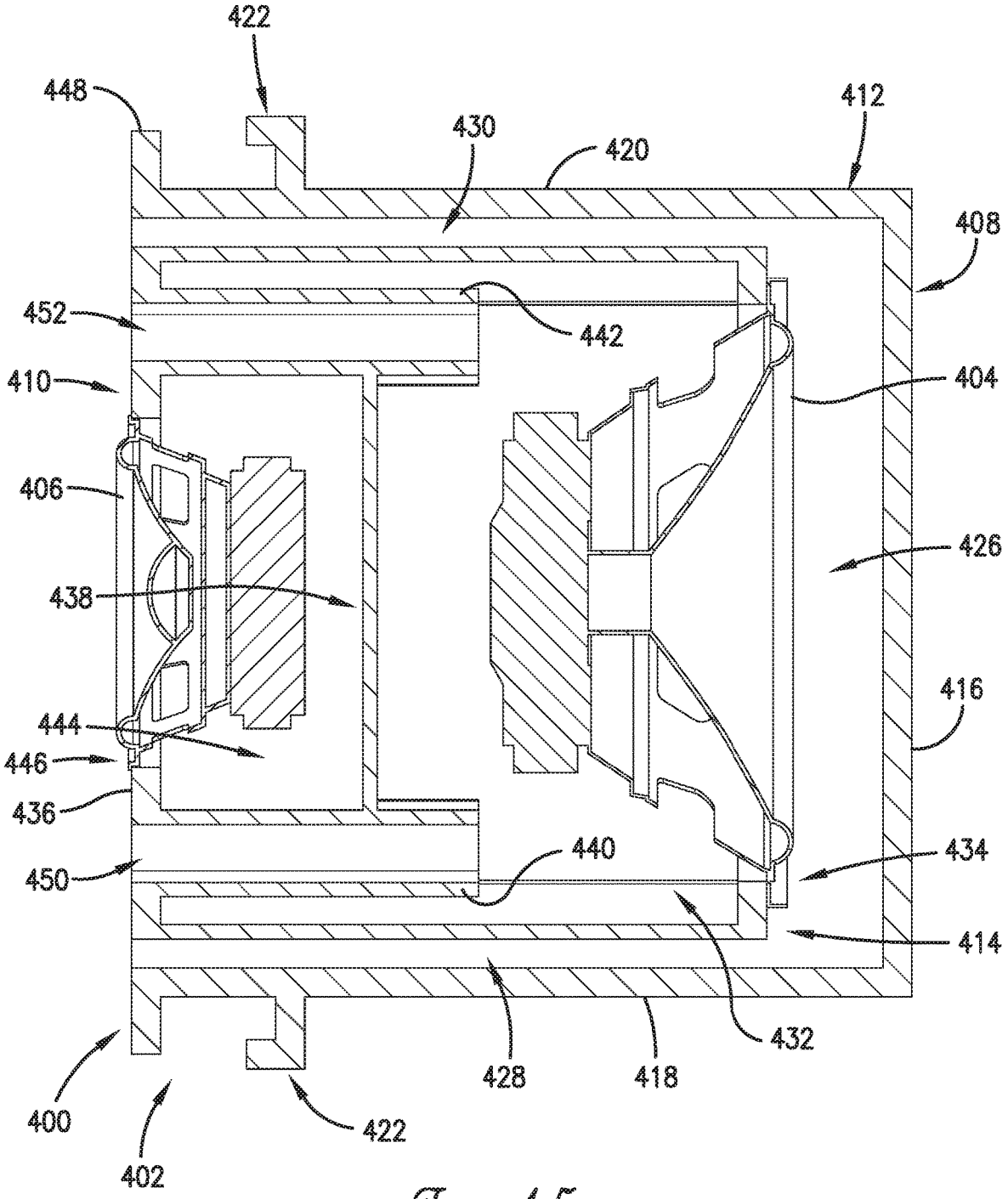
FIG. 15 is a cutaway elevation view of the speaker assembly of FIG. 14.

Turning to FIGS. 12-17, and with particular attention to FIGS. 12 and 13, a speaker assembly 400 constructed in accordance with another embodiment of the invention is illustrated. The speaker assembly 400 broadly comprises a speaker housing 402, an input circuit, a low range speaker 404, and a higher range speaker 406.

The speaker housing 402 broadly comprises a rear section 408 and a forward section 410 for protecting the input circuit and the speakers 404, 406 from the surrounding environment. In one embodiment, the speaker housing 402 may have an outer diameter of between five inches and twelve inches. The speaker housing 402 may be substantially cuboid or cubic (FIGS. 12, 13, 16, and 17), cylindrical (FIGS. 14 and 15) or any other suitable shape. The rear section 408 and forward section 410 may alternatively be oriented as an upper section and a lower section in a ceiling-mount configuration (FIGS. 14 and 15) or a lower section and an upper section in a floor-mount configuration.

The rear section 408 includes an outer shell 412 and an inner wall 414. The outer shell 412 may include a back wall 416, left and right sidewalls 418, 420, and top and bottom walls. The outer shell 412 may also include left and right (or top and bottom etc.) mounting tabs 422. In some embodiments, the outer shell 412 may include zero mounting tabs, one mounting tab, or additional mounting tabs 424 (see FIG. 14).

The outer shell 412 and the inner wall 414 form a rear chamber 426 and left and right slots 428, 430. The rear chamber 426 may be positioned behind the inner wall 414 and in front of the back wall 416 of the outer shell 412. The inner wall 414 also forms an intermediate chamber 432 and may include an opening 434 connecting the rear chamber 426 and the intermediate chamber 432 (in which the low range speaker 404 is mounted).

The left and right slots 428, 430 extend from the rear chamber 426 through a front wall of the forward section 410. In one embodiment, the left and right slots 428, 430 are narrow passageways with a height equal to or greater than a height of the low range speaker 404. Alternatively, top and bottom slots (having a width equal to or greater than a width of the low range speaker 404) may be used. The slots 428, 430 increase the efficiency of the low range speaker 404. The efficiency is increased because the additional mass of the extra air load better matches the mass of the moving low range speaker parts, resulting in a better power transfer from the low range speaker 404 to the air. This is similar to how impedance matching improves electrical power transfer. The increased efficiency allows the use of a smaller low range speaker and smaller chamber, which might otherwise be too large for the application.

The left and right mounting tabs 422, 424 extend laterally from the outer shell 412 for securing the speaker housing 402 to an external structure such as a ceiling or a wall. To that end, the left and right mounting tabs 422, 424 may be L-shaped and/or may include fasteners for attaching the speaker housing 402 to the external structure.

The forward section 410 includes a front wall 436, a rear structure 438, and left and right port bosses 440, 442. The forward section 410 is at least partially positioned in front of the rear section 408 and forms a forward chamber 444.

The front wall 436 includes an opening 446 in which the higher range speaker 406 is mounted. In one embodiment, the front wall 436 includes a flange 448 extending laterally outward beyond the outer shell 412. The flange 448 may be configured for mounting or attaching the speaker assembly 400 to an external structure such as a ceiling or a wall. The flange 448 may extend around a perimeter of the speaker housing 402.

The rear structure 438 may include a rear wall and a number of sidewalls and partitions the forward chamber 444 from the intermediate chamber 432. The rear structure 438 may be connected to or separate from the port bosses 440, 442.

The port bosses 440, 442 extend into the intermediate chamber 432 from the front wall 436 and form left and right ports 450, 452. In other embodiments, fewer or additional ports may be formed. The port bosses 440, 442 may be spaced from and independent from the rear structure 438 or may be part of the rear structure 438. The port bosses 440, 442 may have a longitudinal length corresponding to a desired port length of the left and right ports 450, 452. The desired port length may be chosen to maximize acoustic transfer of energy from the intermediate chamber 432.

The input circuit receives audio signals from a sound system and actively or passively sends the audio signals to the speakers 404, 406. The input circuit may be substantially similar to the input circuits described above. That is, the input circuit may include an antenna, data bus, data port, or any other suitable communication component, an amplifier, a mixer, or any other suitable sound manipulation component. The input circuit may be positioned in the upper section rear section 408, the forward section 410, or any other location for improving signal reception.

The low range speaker 404 generates low frequency soundwaves and may be positioned substantially in the intermediate chamber 432 and facing rearward toward the rear chamber 426 via the opening 434 of the inner wall 414. The low range speaker 404 may be attached to the inner wall near so as to be secured in the opening 434. The low range speaker 404 may be a woofer, subwoofer, bass speaker, or other low-range speaker.

The higher range speaker 406 generates higher frequency soundwaves instead of or in addition to low frequency soundwaves and may be positioned in the forward chamber 444. The higher range speaker 406 may be mounted to the front wall 436 and facing forward via the opening 446 of the front wall 436. The higher range speaker 406 may be a full range speaker, a woofer with a tweeter, a woofer with a midrange and tweeter, or any other similar speaker or combination of speakers.

Use of the above-described speaker assembly 400 will now be described in more detail. The speaker assembly 400 may be spaced apart from other speaker assemblies throughout a listening area such that low frequency soundwaves and higher frequency soundwaves can be received from at least one speaker assembly for most and/or key regions of the listening area. In this way, soundwaves of a particular crossover frequency from a low range speaker locate at a given position and soundwaves of the same crossover frequency from a full range speaker (or a higher-range speaker) located at the same position will not form acoustically muted regions.

The speaker assembly 400 may be mounted in a wall opening via the flange 448 and the mounting tabs 422. This allows the speaker assembly 400 to provide effective audio from a perimeter of a listening area while taking up virtually no space.

The speaker assembly 400 may also be mounted in a ceiling opening. This allows the speaker assembly 400 to provide effective audio from above a listening area while taking up virtually no space. The cylindrical outer shell 412 (shown in FIGS. 14 and 15) allows the speaker assembly 400 to be inserted into a circular ceiling hole. The additional mounting tabs 424 ensure the speaker assembly 400 is retained in the ceiling hole. Similarly, the speaker assembly 400 may be mounted in a floor opening, which allows the speaker assembly 400 to provide effective audio from below a listening area while taking up virtually no space.

Figure 16:
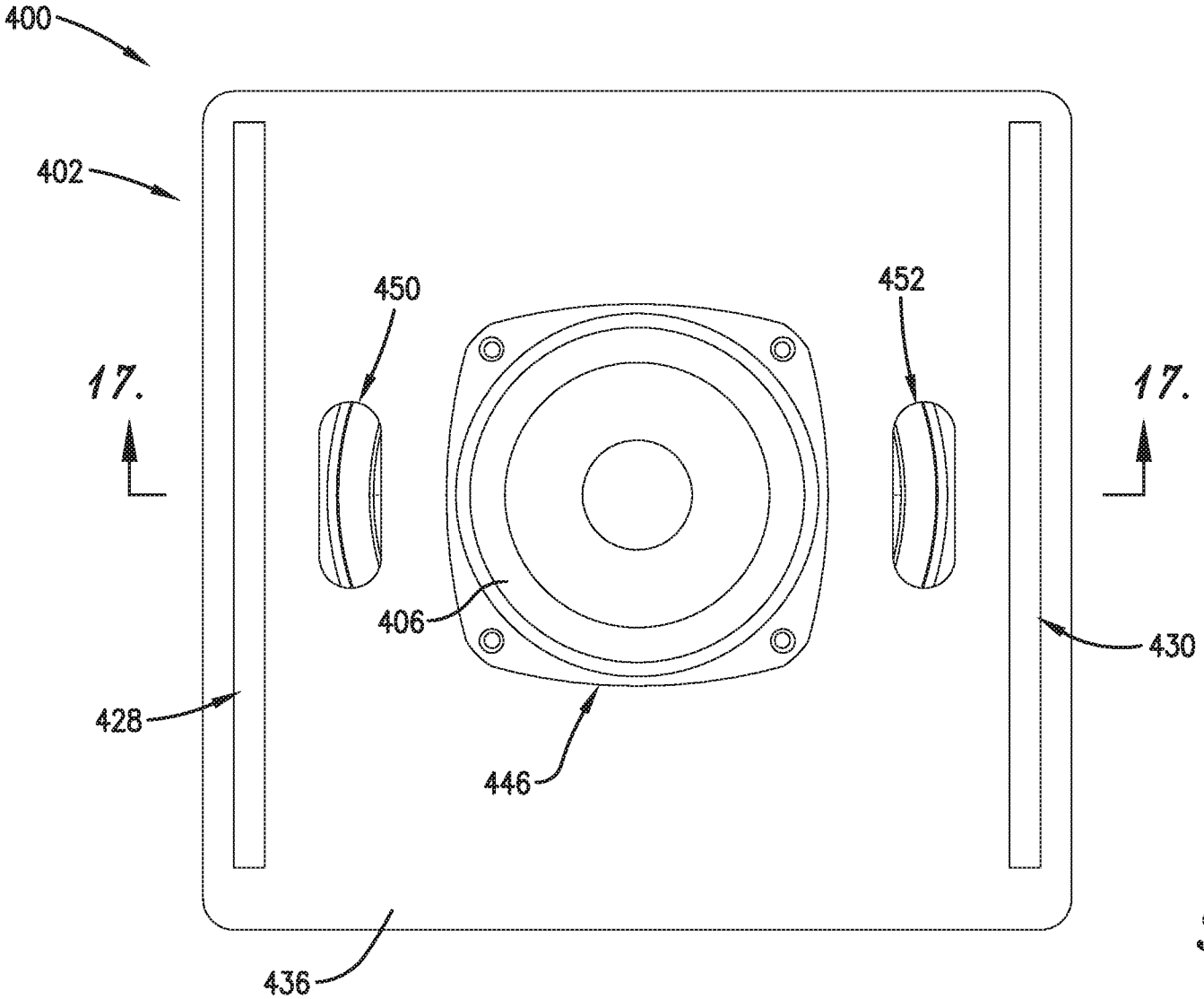
FIG. 16 is a front elevation view of a speaker assembly constructed in accordance with another embodiment of the invention.
Figure 17:
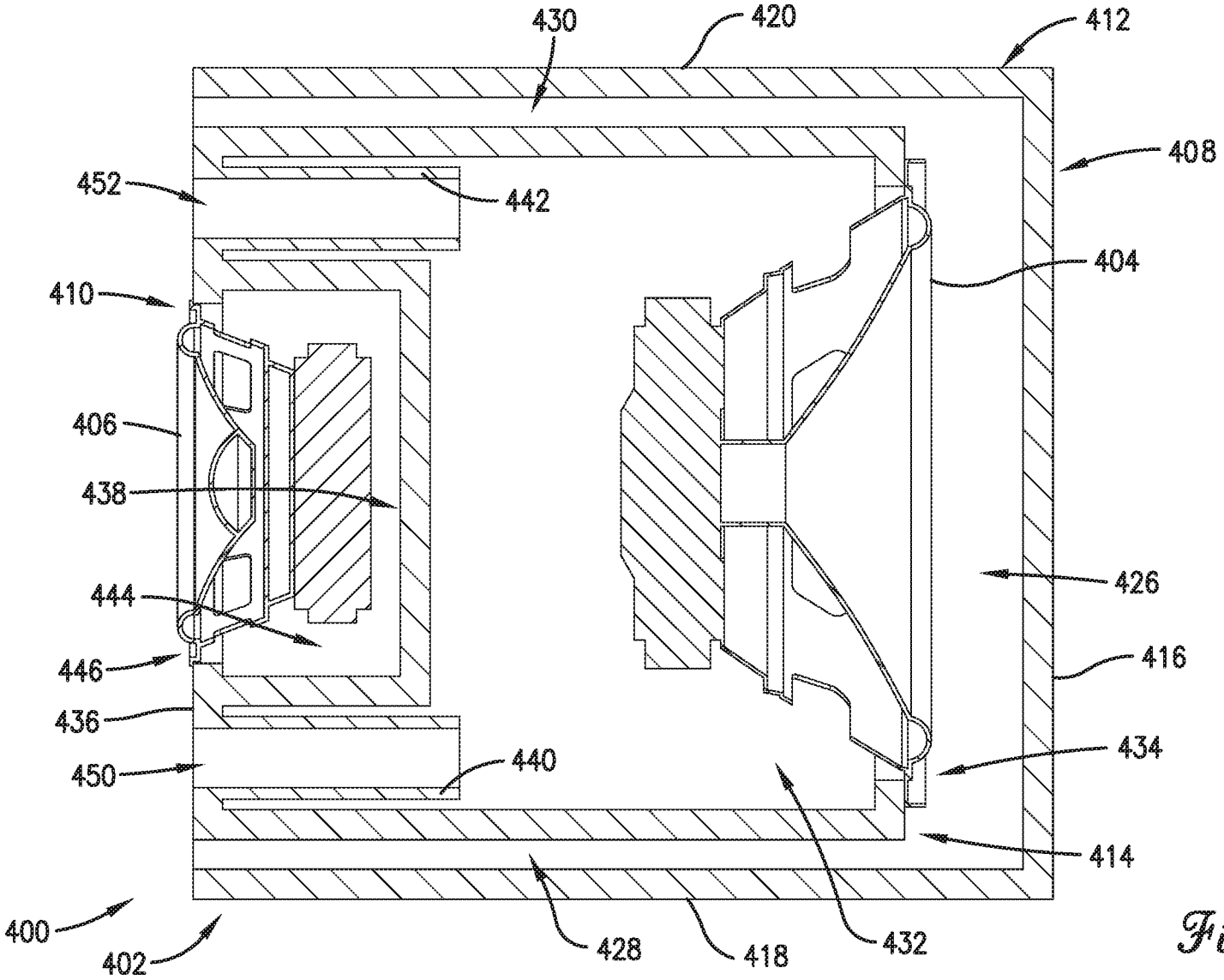
FIG. 17 is a cutaway bottom plan view of the speaker assembly of FIG. 16.

In other embodiments, the front wall 436 does not include a flange and the outer shell 412 does not include mounting tabs (FIGS. 16 and 17). The speaker assembly 400 may therefore be placed on a bookshelf, a countertop, a piece of furniture, a floor surface, or any other suitable structure. As such, the speaker assembly 400 can provide effective audio from virtually any point in a listening area while taking up minimal space.

Positional terms used throughout the above description such as forward, rear, top, bottom, left, and right are relative and are not to be construed as absolute. The various embodiments herein are described via exemplary orientations and are not limited to such orientations.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A speaker assembly comprising:

a speaker housing including:

a rear section having an outer shell and an inner wall, the outer shell and the inner wall defining a rear chamber and a slot, the inner wall further defining an intermediate chamber; and a forward section at least partially extending into the intermediate chamber, the forward section having a front wall and a rear structure defining a forward chamber;

wherein the slot connects the rear chamber to ambient air through the front wall;

an input circuit for receiving audio signals from an audio source;

a low range speaker positioned at least partially in the intermediate chamber and facing rearward, the low range speaker being coupled with the input circuit for generating low frequency soundwaves and projecting the low frequency soundwaves into the rear chamber so that the low frequency soundwaves pass forward from the rear chamber through the slot to ambient air;

a higher range speaker positioned in the forward chamber and coupled with the input circuit for generating higher frequency soundwaves;

the speaker assembly being configured to be spaced from other speaker assemblies such that each speaker assembly produces low frequency soundwaves and higher frequency soundwaves so as to reduce out-of-phase crossover frequency wave cancellation effects within a listening area of the speaker assembly.

2. The speaker assembly of claim 1, the inner wall of the rear section including a rear portion and a side portion, the rear portion including an opening between the rear chamber and the intermediate chamber, the low range speaker being mounted in the opening.

3. The speaker assembly of claim 1, the forward section further including a plurality of ports connecting the intermediate chamber to ambient air through the front wall.

4. The speaker assembly of claim 1, the low range speaker facing rearward.

5. The speaker assembly of claim 1, the slot having a height or a width equal to or greater than a height or a width of the low range speaker.

6. The speaker assembly of claim 1, the front wall extending laterally beyond the outer shell so as to form a flange configured to overlap an external structure.

7. The speaker assembly of claim 1, further comprising a plurality of mounting tabs on the outer shell.

8. The speaker assembly of claim 7, the mounting tabs being L-shaped.

9. The speaker assembly of claim 1, the outer wall being cylindrical and the front wall being circular.

10. The speaker assembly of claim 9, the slot having an arcuate cross-section.

11. A speaker assembly comprising:

a speaker housing including:

a rear section having an outer shell and an inner wall, the outer shell and the inner wall defining a rear chamber and a plurality of slots, the inner wall further defining an intermediate chamber, the rear section having a width of between 7 inches and 12 inches and a height of between 7 inches and 12 inches, and a forward section at least partially extending into the intermediate chamber, the forward section having a front wall and a rear structure defining a forward chamber, wherein the plurality of slots connect the rear chamber to ambient air through the front wall;

an input circuit for receiving audio signals from an audio source;

a low range speaker positioned at least partially in the intermediate chamber and coupled with the input circuit for generating low frequency soundwaves and projecting the low frequency soundwaves into the rear chamber so that the low frequency soundwaves pass forward from the rear chamber through the plurality of slots to ambient air;

a higher range speaker positioned in the forward chamber and coupled with the input circuit for generating higher frequency soundwaves;

the speaker assembly being configured to be spaced from other speaker assemblies such that each speaker assembly produces low frequency soundwaves and higher frequency soundwaves so as to reduce out-of-phase crossover frequency wave cancellation effects within a listening area of the speaker assembly.

12. The speaker assembly of claim 11, the inner wall of the rear section including a rear portion and a side portion, the rear portion including an opening between the rear chamber and the intermediate chamber, the low range speaker being mounted in the opening.

13. The speaker assembly of claim 11, the forward section further including a plurality of ports connecting the intermediate chamber to ambient air through the front wall.

14. The speaker assembly of claim 11, the low range speaker facing rearward.

15. The speaker assembly of claim 11, each slot having a height or a width equal to or greater than a height or a width of the low range speaker.

16. The speaker assembly of claim 11, the front wall extending laterally beyond the outer shell so as to form a flange configured to overlap an external structure.

17. The speaker assembly of claim 11, further comprising a plurality of mounting tabs on the outer shell.

18. The speaker assembly of claim 11, the outer wall being cylindrical and the front wall being circular.

19. The speaker assembly of claim 18, the ports and the slots having arcuate cross-sections.

20. A speaker assembly comprising:

a speaker housing including:

a rear section having an outer shell and an inner wall, the outer shell and the inner wall defining a rear chamber and a plurality of slots, the inner wall further defining an intermediate chamber, the rear section having a width of between 7 inches and 12 inches and a height of between 7 inches and 12 inches, and a forward section at least partially extending into the intermediate chamber, the forward section having front wall and a rear structure defining a forward chamber, wherein the plurality of slots connect the rear chamber to ambient air through the front wall;

an input circuit for receiving audio signals from an audio source;

a low range speaker positioned at least partially in the intermediate chamber and coupled with the input circuit for generating low frequency soundwaves and projecting the low frequency soundwaves into the rear chamber so that the low frequency soundwaves pass forward from the rear chamber through the plurality of slots to ambient air;

a higher range speaker positioned in the forward chamber and coupled with the input circuit for generating higher frequency soundwaves;

the horizontal speaker assembly being configured to be spaced from other speaker assemblies such that each speaker assembly produces low frequency soundwaves and higher frequency soundwaves so as to reduce out-of-phase crossover frequency wave cancellation effects within a listening area of the speaker assembly.

* * * * *